US006986388B2

(12) United States Patent
Zupanick et al.

(10) Patent No.: US 6,986,388 B2
(45) **Date of Patent: *Jan. 17, 2006**

(54) METHOD AND SYSTEM FOR ACCESSING A SUBTERRANEAN ZONE FROM A LIMITED SURFACE AREA

(75) Inventors: Joseph A. Zupanick, Pineville, WV (US); Monty H. Rial, Dallas, TX (US)

(73) Assignee: CDX Gas, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/406,037

(22) Filed: Apr. 2, 2003

(65) Prior Publication Data

US 2003/0217842 A1 Nov. 27, 2003

Related U.S. Application Data

(63) Continuation of application No. 09/774,996, filed on Jan. 30, 2001, now Pat. No. 6,662,870.

(51) Int. Cl.
*E21B 43/00* (2006.01)

(52) U.S. Cl. ..... 166/245; 166/313

(58) Field of Classification Search ..... 166/50, 166/52, 313, 245

See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |
| 1,189,560 | A | 7/1916 | Gondos |

(Continued)

FOREIGN PATENT DOCUMENTS

| | | |
|---|---|---|
| CA | 2210866 | 1/1998 |
| CA | 2 278 735 | 1/1998 |
| DE | CH 653 741 | 1/1986 |
| DE | 197 25 996 A1 | 1/1998 |
| EP | 0 819 834 A1 | 1/1998 |

(Continued)

OTHER PUBLICATIONS

Joseph A. Zupanick; Declaration of Experimental Use, pp 1–3, Nov. 14, 2000.

Howard L. Hartman, et al.; "*SME Mining Engineering Handbook,*" Society for Mining, Metallurgy, and Exploration, Inc.; pp 1946–1950, 2nd Edition, vol. 2, 1992.

Dave Hassan, Mike Chernichen, Earl Jensen, and Morley Frank; "*Multi–lateral technique lowers drilling costs, provides environmental benefits*", Drilling Technology, pp 41–47, Oct. 1999.

Pending Patent Application, Joseph A. Zupanick, "*Method and System for Enhanced Access to a Subterrean Zone,*" U.S. Appl. No. 09/769,098, Jan. 24, 2001.

(Continued)

*Primary Examiner*—John Kreck
(74) *Attorney, Agent, or Firm*—Fish & Richardson P.C.

(57) ABSTRACT

A method and system for accessing subterranean resources from a limited surface area includes a first well bore extending from the surface to the target zone. The first well bore includes an angled portion disposed between the target zone and the surface to provide an offset between a surface location of the first well bore and an intersection of the first well bore with the subterranean resource. The system also includes an articulated well bore extending from the surface to the target zone. The articulated well bore is offset from the first well bore at the surface and intersects the first well bore proximate the target zone. The system further includes a well bore pattern extending from the intersection of the first well bore and the articulated well bore in the target zone to provide access to the target zone.

33 Claims, 11 Drawing Sheets

U.S. PATENT DOCUMENTS

| | | | | |
|---|---|---|---|---|
| 1,285,347 | A | 11/1918 | Otto | |
| 1,467,480 | A | 9/1923 | Hogue | |
| 1,485,615 | A | 3/1924 | Jones | |
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Böll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,797,893 | A | 7/1957 | McCune et al. | |
| 2,847,189 | A | 8/1958 | Shook | 255/76 |
| 2,911,008 | A | 11/1959 | Bois | 137/625.31 |
| 2,980,142 | A | 4/1961 | Turak | 137/637.3 |
| 3,208,537 | A | 9/1965 | Scarborough | |
| 3,347,595 | A | 10/1967 | Dahms et al. | 299/4 |
| 3,385,382 | A | 5/1968 | Canalizo et al. | |
| 3,443,648 | A | 5/1969 | Howard | 175/103 |
| 3,473,571 | A | 10/1969 | Dugay | 137/624.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,582,138 | A | 6/1971 | Loofbourow et al. | |
| 3,587,743 | A | 6/1971 | Howard | |
| 3,684,041 | A | 8/1972 | Kammerer, Jr. et al. | 175/267 |
| 3,692,041 | A | 9/1972 | Bondi | 137/238 |
| 3,744,565 | A | 7/1973 | Brown | |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | |
| 3,934,649 | A | 1/1976 | Pasini, III et al. | 166/254 |
| 3,957,082 | A | 5/1976 | Fuson et al. | 137/625.41 |
| 4,011,890 | A | 3/1977 | Andersson | 137/625.4 |
| 4,020,901 | A | 5/1977 | Pisio et al. | |
| 4,022,279 | A | 5/1977 | Driver | 166/271 |
| 4,030,310 | A | 6/1977 | Schirtzinger | |
| 4,037,658 | A | 7/1977 | Anderson | 166/272 |
| 4,060,130 | A | 11/1977 | Hart | |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,134,463 | A | 1/1979 | Allen | |
| 4,136,996 | A | 1/1979 | Burns | |
| 4,151,880 | A | 5/1979 | Vann | |
| 4,156,437 | A | 5/1979 | Chivens et al. | 137/554 |
| 4,169,510 | A | 10/1979 | Meigs | 175/65 |
| 4,182,423 | A | 1/1980 | Ziebarth et al. | |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,222,611 | A | 9/1980 | Larson et al. | |
| 4,224,989 | A | 9/1980 | Blount | |
| 4,226,475 | A | 10/1980 | Frosch et al. | |
| 4,257,650 | A | 3/1981 | Allen | 299/2 |
| 4,278,137 | A | 7/1981 | Van Eed | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,303,127 | A | 12/1981 | Freel et al. | |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A | 6/1982 | Lyons et al. | 175/61 |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | William | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,415,205 | A | 11/1983 | Rehm et al. | |
| 4,417,829 | A | 11/1983 | Berezoutzky | |
| 4,422,505 | A | 12/1983 | Collins | |
| 4,437,706 | A | 3/1984 | Johnson | |
| 4,442,896 | A | 4/1984 | Reale et al. | 166/278 |
| 4,463,988 | A | 8/1984 | Bouck et al. | |
| 4,494,616 | A | 1/1985 | McKee | 175/67 |
| 4,502,733 | A | 3/1985 | Grubb | |
| 4,519,463 | A | 5/1985 | Schuh | 175/61 |
| 4,527,639 | A | 7/1985 | Kickinson, III et al. | 175/61 |
| 4,532,986 | A | 8/1985 | Mims et al. | 166/50 |
| 4,533,182 | A | 8/1985 | Richards | |
| 4,536,035 | A | 8/1985 | Huffman et al. | |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,603,592 | A | 8/1986 | Siebold et al. | |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,651,836 | A | 3/1987 | Richards | |
| 4,674,579 | A | 6/1987 | Geller et al. | 175/45 |
| 4,702,314 | A | 10/1987 | Huang et al. | 166/245 |
| 4,705,431 | A | 11/1987 | Gadelle et al. | 405/267 |
| 4,715,440 | A | 12/1987 | Boxell et al. | 166/100 |
| 4,753,485 | A | 6/1988 | Goodhart | |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,776,638 | A | 10/1988 | Hahn | |
| 4,830,105 | A | 5/1989 | Petermann | 166/241 |
| 4,832,122 | A | 5/1989 | Corey et al. | |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/263 |
| 4,889,186 | A | 12/1989 | Hanson et al. | |
| 4,978,172 | A | 12/1990 | Schwoebel et al. | 299/12 |
| 5,016,710 | A | 5/1991 | Renard et al. | 166/245 |
| 5,035,605 | A | 7/1991 | Dinerman et al. | 425/564 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,111,893 | A | 5/1992 | Kvello-Aune | 175/258 |
| 5,121,244 | A | 6/1992 | Takasaki | 359/161 |
| 5,127,457 | A | 7/1992 | Stewart et al. | |

5,135,058 A 8/1992 Millgard et al. ..... 175/71
5,148,875 A 9/1992 Karlsson et al. ..... 175/62
5,148,877 A 9/1992 MacGregor
5,165,491 A 11/1992 Wilson ..... 175/62
5,168,942 A 12/1992 Wydrinski ..... 175/50
5,174,374 A 12/1992 Hailey ..... 166/55.8
5,193,620 A 3/1993 Braddick ..... 166/382
5,194,859 A 3/1993 Warren ..... 340/853.4
5,194,977 A 3/1993 Nishio ..... 359/128
5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,226,495 A 7/1993 Jennings, Jr. ..... 166/278
5,240,350 A 8/1993 Yamaguchi et al. ..... 405/143
5,242,017 A 9/1993 Hailey ..... 166/55.8
5,242,025 A 9/1993 Neill et al. ..... 175/26
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,301,760 A 4/1994 Graham ..... 175/61
5,355,967 A 10/1994 Mueller et al.
5,363,927 A 11/1994 Frank ..... 175/67
5,402,851 A 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al. ..... 166/265
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A 7/1995 Smith ..... 175/61
5,447,416 A 9/1995 Wittrisch
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,469,155 A 11/1995 Archambeault et al. . 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,501,273 A 3/1996 Puri ..... 166/252.5
5,501,279 A 3/1996 Garg et al. ..... 166/372
5,584,605 A 12/1996 Beard et al. ..... 405/128
5,613,242 A 3/1997 Oddo
5,615,739 A 4/1997 Dallas ..... 166/306
5,653,286 A 8/1997 McCoy et al. ..... 166/105.5
5,659,347 A 8/1997 Taylor ..... 347/85
5,669,444 A 9/1997 Riese et al. ..... 166/263
5,676,207 A 10/1997 Simon et al.
5,680,901 A 10/1997 Gardes ..... 166/313
5,697,445 A 12/1997 Graham
5,706,871 A 1/1998 Andersson et al. ..... 141/59
5,720,356 A 2/1998 Gardes ..... 175/62
5,727,629 A 3/1998 Blizzard, Jr. et al. ..... 166/298
5,735,350 A 4/1998 Longbottom et al. ..... 166/313
5,771,976 A 6/1998 Talley ..... 166/370
5,775,433 A 7/1998 Hammett et al. ..... 166/98
5,775,443 A 7/1998 Lott
5,785,133 A 7/1998 Murray et al. ..... 175/61
5,832,958 A 11/1998 Cheng ..... 137/625.41
5,852,505 A 12/1998 Li ..... 359/118
5,853,054 A 12/1998 McGarian et al. ..... 175/267
5,853,056 A 12/1998 Landers ..... 175/424
5,853,224 A 12/1998 Riese
5,863,283 A 1/1999 Gardes ..... 588/250
5,867,289 A 2/1999 Gerstel et al. ..... 359/110
5,868,202 A 2/1999 Hsu ..... 166/256
5,868,210 A 2/1999 Johnson et al. ..... 175/40
5,879,057 A 3/1999 Schwoebel et al. ..... 299/17
5,884,704 A 3/1999 Longbottom et al. ..... 16/313
5,912,754 A 6/1999 Koga et al. ..... 359/179
5,914,798 A 6/1999 Liu ..... 359/161
5,917,325 A 6/1999 Smith ..... 324/326
5,934,390 A 8/1999 Uthe ..... 175/67
5,938,004 A 8/1999 Roberts et al. ..... 198/812
5,941,308 A 8/1999 Malone et al.
5,957,539 A 9/1999 Durup et al. ..... 299/4
5,971,074 A 10/1999 Longbottom et al. ..... 166/313
6,012,520 A 1/2000 Yu et al. ..... 166/245
6,015,012 A 1/2000 Reddick ..... 166/313
6,019,173 A 2/2000 Saurer et al.
6,024,171 A 2/2000 Montgomery et al. ..... 166/308
6,030,048 A 2/2000 Hsu
6,050,335 A 4/2000 Parsons ..... 166/272.3
6,056,059 A 5/2000 Ohmer ..... 166/313
6,062,306 A 5/2000 Gano et al.
6,065,550 A 5/2000 Gardes ..... 175/62
6,065,551 A 5/2000 Gourley et al.
6,119,771 A 9/2000 Gano et al. ..... 166/50
6,119,776 A 9/2000 Graham et al.
6,135,208 A 10/2000 Gano et al. ..... 166/313
6,179,054 B1 1/2001 Stewart ..... 166/105.5
6,189,616 B1 2/2001 Gano et al.
6,209,636 B1 4/2001 Roberts et al. ..... 166/117.6
6,237,284 B1 5/2001 Erickson
6,244,340 B1 6/2001 McGlothen et al.
6,279,658 B1 8/2001 Donovan et al.
6,280,000 B1 8/2001 Zupanick ..... 299/12
6,349,769 B1 2/2002 Ohmer ..... 166/313
6,357,523 B1 3/2002 Zupanick ..... 166/52
6,357,530 B1 3/2002 Kennedy et al. ..... 166/369
6,425,448 B1 7/2002 Zupanick et al. ..... 175/61
6,439,320 B2 8/2002 Zupanick ..... 175/61
6,450,256 B2 9/2002 Mones
6,454,000 B1 9/2002 Zupanick ..... 166/243
6,457,540 B2 10/2002 Gardes
6,478,085 B2 11/2002 Zupanick ..... 166/50
6,497,556 B2 12/2002 Zupanick ..... 417/85
6,561,288 B2 * 5/2003 Zupanick ..... 175/69
6,566,649 B1 5/2003 Mickael ..... 250/269.3
6,571,888 B2 6/2003 Comeau ..... 175/61
6,575,235 B2 6/2003 Zupanick ..... 166/50
6,575,255 B1 6/2003 Rial et al.
6,577,129 B1 6/2003 Thompson ..... 324/338
6,585,061 B2 7/2003 Radzinski ..... 175/45
6,590,202 B2 7/2003 Mickael ..... 250/269.4
6,591,903 B2 7/2003 Ingle ..... 166/50
6,591,922 B1 7/2003 Rial et al.
6,595,301 B1 7/2003 Diamond et al.
6,595,302 B1 7/2003 Diamond et al.
6,598,686 B1 * 7/2003 Zupanick ..... 175/62
6,604,580 B2 8/2003 Zupanick ..... 166/245
6,604,910 B1 8/2003 Zupanick ..... 417/36
6,607,042 B2 8/2003 Hoyer et al. ..... 175/38
6,636,159 B1 10/2003 Winnacker ..... 340/854.3
6,639,210 B2 10/2003 Odom et al. ..... 250/269.6
6,644,422 B1 11/2003 Rial et al.
6,646,411 B2 11/2003 Hirono et al. ..... 324/338
6,646,441 B2 11/2003 Thompson et al.
6,653,839 B2 11/2003 Yuratich et al. ..... 324/355
6,662,870 B1 12/2003 Zupanick ..... 166/245
6,668,918 B2 * 12/2003 Zupanick ..... 166/50
6,679,322 B1 * 1/2004 Zupanick ..... 166/50
6,681,855 B2 1/2004 Zupanick ..... 166/50
6,688,388 B2 2/2004 Zupanick ..... 166/50
6,708,764 B2 3/2004 Zupanick
6,722,452 B1 4/2004 Rial et al.
6,725,922 B2 4/2004 Zupanick
6,758,279 B2 7/2004 Moore et al.

| | | | | |
|---|---|---|---|---|
| 2001/0010432 | A1 * | 8/2001 | Zupanick | 299/12 |
| 2001/0015574 | A1 * | 8/2001 | Zupanick | 299/12 |
| 2001/0096336 | | 11/2001 | Zupanick | 175/161 |
| 2002/0043404 | A1 | 4/2002 | Trueman et al. | |
| 2002/0050358 | A1 | 5/2002 | Algeroy | 166/313 |
| 2002/0074120 | A1 | 6/2002 | Scott | 166/313 |
| 2002/0074122 | A1 | 6/2002 | Kelly et al. | 166/313 |
| 2002/0096336 | A1 | 7/2002 | Zupanick et al. | |
| 2002/0108746 | A1 | 8/2002 | Zupanick | 166/50 |
| 2002/0117297 | A1 | 8/2002 | Zupanick | 166/50 |
| 2002/0134546 | A1 * | 9/2002 | Zupanick | 166/52 |
| 2002/0148605 | A1 * | 10/2002 | Zupanick | 166/50 |
| 2002/0148613 | A1 * | 10/2002 | Zupanick | 166/313 |
| 2002/0148647 | A1 * | 10/2002 | Zupanick | 175/52 |
| 2002/0189801 | A1 | 12/2002 | Zupanick | 166/50 |
| 2003/0062198 | A1 | 4/2003 | Gardes | 175/61 |
| 2003/0066686 | A1 | 4/2003 | Conn | 175/57 |
| 2003/0075334 | A1 | 4/2003 | Haugen et al. | 166/313 |
| 2003/0106686 | A1 | 6/2003 | Ingle et al. | 166/245 |
| 2003/0164253 | A1 | 9/2003 | Trueman et al. | |
| 2003/0221836 | A1 | 12/2003 | Gardes | |
| 2004/0007389 | A1 | 1/2004 | Zupanick | 175/61 |
| 2004/0007390 | A1 | 1/2004 | Zupanick | 175/61 |
| 2004/0011560 | A1 | 1/2004 | Rial et al. | |
| 2004/0031609 | A1 | 2/2004 | Zupanick | |
| 2004/0033557 | A1 | 2/2004 | Scott et al. | |
| 2004/0035582 | A1 | 2/2004 | Zupanick | |
| 2004/0050552 | A1 | 3/2004 | Zupanick | |
| 2004/0050554 | A1 | 3/2004 | Zupanick et al. | |
| 2004/0055787 | A1 | 3/2004 | Zupanick | |
| 2004/0060351 | A1 | 4/2004 | Gunter et al. | |
| 2004/0140129 | A1 | 7/2004 | Gardes | |
| 2004/0159436 | A1 | 8/2004 | Zupanick | |
| 2004/0226719 | A1 | 11/2004 | Morgan et al. | |

FOREIGN PATENT DOCUMENTS

| | | | |
|---|---|---|---|
| EP | 0 875 661 | A1 | 11/1998 |
| EP | 0 952.300 | A1 | 10/1999 |
| EP | 1 316 673 | A2 | 6/2003 |
| FR | 964503 | | 8/1950 |
| GB | 442008 | | 1/1936 |
| GB | 444484 | | 3/1936 |
| GB | 651468 | | 4/1951 |
| GB | 893869 | | 4/1962 |
| GB | 2 255 033 | | 10/1992 |
| GB | 2297 988 | | 8/1996 |
| GB | 2347157 | | 8/2002 |
| RU | SU-750108 | | 6/1975 |
| RU | SU-1448078 | A1 | 3/1987 |
| RU | SU-1770570 | A1 | 3/1990 |
| SU | 876968 | | 10/1981 |
| WO | 94/21889 | | 9/1994 |
| WO | WO 94/28280 | | 12/1994 |
| WO | WO 97/21900 | | 6/1997 |
| WO | WO 98/35133 | | 8/1998 |
| WO | WO 99/60248 | | 11/1999 |
| WO | WO 00/31376 | | 2/2000 |
| WO | WO 00/79099 | A1 | 12/2000 |
| WO | WO 01/44620 | | 6/2001 |
| WO | WO 02/18738 | | 3/2002 |
| WO | WO 02/059455 | A1 | 8/2002 |
| WO | WO 03/061238 | | 8/2002 |
| WO | WO 03/102348 | | 12/2003 |
| WO | WO 2004/035984 | A1 | 4/2004 |

OTHER PUBLICATIONS

Pending Patent Application, Joseph A. Zupanick, *Method and System for Accessing Subterranean Deposits from the Surface*, U.S. Appl. No. 09/788,897, filed Feb. 20, 2001.

Pend Pat App, Joseph A. Zupanick "*Method and System for Enhanced Access to a Subterranean Zone*" U.S. Appl. No. 09/769,098 (067083.0118), filed Jan. 24, 2001.

Gopal Ramaswamy, "*PRoduction History Provides CBM Insights,*" Oil & Gas Journal pp. 49, 50 & 52, Apr. 2, 2001.

Pend Pat App, Joseph A. Zupanick, "*Method and System for Accessing Subterranean Deposits From The Surface*" U.S. Appl. No. 09/885,219 (067083.0140), filed Jun. 20, 2001.

Weiguo Chi & Luwu Yang, "*Feasibility of Coalbed Methane Exploitation in China,*" Horizontal Well Technology, p. 74, Sep. 2001.

Pend Pat App, Joseph A. Zupanick et al., "*Method and System for Management of By–Products From Subterranean Zones*" U.S. Appl. No. 10/046,001 (067083.0134), Oct. 19, 2001.

Nackerud Product Description, Received Sep. 27, 2001.

Gopal Ramaswamy, "*Advances Key For Coalbed Methane,*" The American Oil & Gas Reporter, pp. 71 & 73, Oct. 2001.

R.J. "Bob" Stayton, "Horizontal Wells Boost CBM Recovery", Special Report: Horizontal & Directional Drilling, *The American Oil & Gas Reporter,* pp. 71–75, Aug. 2002.

Afron H. Jones et al., "A Review of the Physical and Mechanical Properties of Coal with Implications for Coal–Bed Methane Well Completion and Production", *Rocky Mountain Association of Geologists,* pp 169–181, 1988.

Joseph C. Stevens, Horizontal Applications for Coal Bed Methane Recovery, 3rd Annual Coalbed and Coal Mine Conference, *Strategic Research Institute,* pp 1–10 slides, Mar. 25, 2002.

McCray and Cole, "*Oil Well Drilling and Technology,*" University of Oklahoma Press, pp 315–319, 1959.

Berger and Anderson, "*Modern Petroleum;*" PennWell Books, pp 106–108, 1978.

Susan Eaton, "Reversal of Fortune", New Technology Magazine, pp. 30–31, Sep. 2002.

James Mahony, "A Shadow of Things to Come", New Technology Magazine, pp. 28–29, Sep. 2002.

Documents Received from Third Party, Great Lakes Directional Drilling, Inc., (12 pages), Received Sep. 12, 2002.

Examiner of Record, Office Action Response regarding the Interpretation of the three Russian Patent Applications listed above under Foreign Patent Documents (9 pages), date unknown.

Robert W. Taylor and Richard Russell, Multilateral Technologies Increase Operational Efficiencies in Middle East, Oil & Gas Journal, pp. 76–80, Mar. 16, 1998.

Adam Pasiczynk, "Evolution Simplifies Multilateral Wells", Directional Drilling, pp. 53–55, Jun. 2000.

Steven S. Bell, "Multilateral System with Full Re–Entry Access Installed", World Oil, p. 29, Jun. 1996.

Pascal Breant, "Des Puits Branches, Chez Total : les puits multi drains", Total Exploration Production, pp. 1–5, Jan. 1999.

Chi, Weiguo, "*A Feasible Discussion on Exploitation Coalbed Methane through Horizontal Network Drilling in China*", SPE 64709, Society of Petroleum Engineers (SPE International), 4 pages, Nov. 7, 2000.

Chi, Weiguo, "*Feasibility of Coalbed Methane Exploitation in China*", synopsis of paper SPE 64709, 1 page, Nov. 7, 2000.

Ian D. Palmer et al., "*Coalbed Methane Well Completions and Stimulations*", Chapter 14, pp. 303–339, Hydrocarbons from Coal, Published by the American Association of Petroleum Geologists, 1993.

Zupanick, U.S. Appl. No. 10/264,535, "Method and System for Removing Fluid From a Subterranean Zone Using an Enlarged Cavity", Aug. 15, 2003.

Notification of Transmittal of the International Search Report or the Declaration (PCT Rule 44.1) mailed Nov. 6, 2003 (8 pages) re International Application No. PCT/US 03/21626, Jul. 11, 2003.

Notification of Transmittal of the International Search Report or the Declaration (PCT Rule 44.1) mailed Nov. 5, 2003 (8 pages) re International Application No. PCT/US 03/21627, Jul. 11, 2003.

Notification of Transmittal of the International Search Report or the Declaration (PCT Rule 44.1) mailed Nov. 4, 2003 (7 pages) re International Application No. PCT/US 03/21628, Jul. 11, 2003.

Notification of Transmittal of the International Search Report or the Declaration (PCT Rule 44.1) mailed Dec. 5, 2003 (8 pages) re International Application No. PCT/US 03/21750, Jul. 11, 2003.

Notification of Transmittal of the International Search Report or the Declaration (PCT Rule 44.1) mailed Dec. 19, 2003 (8 pages) re International Application No. PCT/US 03/28137, Filed Sep. 9, 2003.

Notification of Transmittal of the International Search Report or the Declaration (PCT Rule 44.1) mailed Feb. 4, 2004 (8 pages) re International Application No. PCT/US 03/26124, Filed Sep. 9, 2003.

Smith, Maurice, "*Chasing Unconventional Gas Uncoventionally,*" CBM Gas Technology, New Technology Magazine, Oct./Nov. 2003, pp. 1–4.

Gardes, Robert "*A New Direction in Coalbed Methane and Shale Gas Recovery,*" (to the best of Applicants' recollection, first received at the Canadian Institute Coalbed Methane Symposium conference on Jun. 16 and Jun. 17, 2002), 1 page of conference flyer, 6 pages of document.

Gardes, Robert, "*Under–Balance Multi–Lateral Drilling for Unconventional Gas Recovery,*" (to the best of Applicants' recollection, first received at The Unconventional Gas Revolution conference on Dec. 9, 2003), 4 pages of conference flyer, 33 pages of document.

Boyce, Richard "*High Resolution Selsmic Imaging Programs for Coalbed Methane Development,*" (to the best of Applicants' recollection, first received at The Unconventional Gas Revolution conference on Dec. 10, 2003), 4 pages of conference flyer, 24 pages of document.

Mark Mazzella and David Strickland, "*Well Control Operations on a Multiwell Platform Blowout,*" WorldOil.com—Online Magazine Article, vol. 22, Part I—pp. 1–7, and Part II—pp. 1–13, Jan. 2002.

Vector Magnetics LLC, Case History, California, May 1999, "*Successful Kill of a Surface Blowout,*" pp. 1–12, May, 1999.

Cudd Pressure Control, Inc, "*Successfull Well Control Operations–A Case Study: Surface and Subsurface Well Intervention on a Multi–Well Offshore Platform Blowout and Fire,*" pp. 1–17, http://www.cuddwellcontrol.com/literature/successful/successful_well.htm, 2000.

R. Puri, et al., "*Damage to Coal Permeability During Hydraulic Fracturing,*" pp. 109–115 (SPE 21813), 1991.

U.S. Dept. of Energy—Office of Fossil Energy, "*Multi–Seam Well Completion Technology: Implications for Powder River Basin Coalbed Methane Production,*" pp. 1–100, A–1 through A10, Sep. 2003.

U.S. Dept. of Energy—Office of Fossil Energy, "*Powder River Basin Coalbed Methane Development and Produced Water Management Study,*" pp. 1–111, A–1 through A14, Sep. 2003.

Zupanick, U.S. Patent Application, entitled Method and System for Controlling the Production Rate . . . , U.S. Appl. No. 10/328,408, Dec. 23, 2002.

Rial, U.S. Patent Application, entitled Method and System for Accessing a Subterranean Zone from a Limited Surface Area, U.S. Appl. No. 10/188,141, Jul. 1, 2002.

Zupanick, U.S. Patent Application, entitled "Wellbore Sealing System and Method," U.S. Appl. No. 10/406,037 Published, Jul. 12, 2002.

Notification of Transmittal of the International Search Report or the Declaration (PCT Rule 44.1) mailed Feb. 9, 2004 (6 pages) re International Application No. PCT/US 03/28138, Sep. 9, 2003.

Notification of Transmittal of the International Search Report or the Declaration (PCT Rule 44.1) mailed Feb. 27, 2004 (9 pages) re International Application No. PCT/US 03/30126, Sep. 23, 2003.

Fletcher, "Anadarko Cuts Gas Route Under Canadian River Gorge," Oil and Gas Journal, pp. 28–30, Jan. 25, 2004.

Translation of selected pages of Kalinin, et al., "Drilling and Horizontal Well Bores," Nedra Publishers, Moscow, 1997, 15 pages.

Translation of selected pages of Arens, V.Zh., "Well–Drilling Recovery of Minerals," Geotechnology, Nedra Publishers, Moscow, 7 pages, 1986.

Jackson, P., et al., "*Reducing Long Term Methane Emissions Resulting from Coal Mining,*" Energy Convers. Mgmt, vol. 37, Nos. 6–8, 1996, pp. 801–806, (6 pages).

B. Goktas et al., "*Performances of Openhole Completed and Cased Horizontal/Undulating Wells in Thin–Bedded, Tight Sand Gas Reservoirs,*" SPE 65619, Society of Petroleum Engineers, Oct. 17–19, 2000 (7 pages).

Sharma, R., et al., "*Modelling of Undulating Wellbore Trajectories,*" The Journal of Canadian Petroleum Technology, vol. 34, No. 10, XP–002261908, Oct. 18–20, 1993 pp. 16–24 (9 pages).

Balbinski, E.F., "*Prediction of Offshore Viscous Oil Field Performance,*" European Symposium on Improved Oil Recovery, Aug. 18–20, 1999, 10 pages.

Notification of Transmittal of the International Search Report or the Declaration (PCT Rule 44.1) (3 pages) and International Search Report (7 pages) re International Application No. PCT/US 03/04771 mailed Jul. 4, 2003.

Notification of Transmittal of the International Search Report or the Declaration (PCT Rule 44.1) (3 pages) and International Search Report (5 pages) re International Application No. PCT/US 03/21891 mailed Nov. 13, 2003.

Notification of Transmittal of the International Search Report or the Declaration (PCT Rule 44.1) (3 pages) and International Search Report (4 pages) re International Application No. PCT/US 03/38383 mailed Jun. 2, 2004.

Kalinin, et al., Translation of Selected Pages from Ch. 4, Sections 4.2 (p. 135), 10.1 (p. 402), 10.4 (pp. 418–419), "*Drilling Inclined and Horizontal Well Bores,*" Moscow, Nedra Publishers, 1997, 4 pages.

Jet Lavanway Exploration, "*Well Survey,*" Key Energy Surveys, Nov. 2, 1997, 3 pages.

Precision Drilling, "*We Have Roots in Coal Bed Methane Drilling,*" Technology Services Group, Publisher on or before Aug. 5, 2002, 1 page.

U.S. Dept. of Energy, "*New Breed of CBM/CMM Recovery Technology,*" Jul. 2003, 1 page.

Ghiselin, Dick, "*Unconventional Vision Frees Gas Reserves,*" Natural Gas Quarterly, Sep. 2003, 2 pages.

CBM Review, World Coal, "*US Drilling into Asia,*" Jun. 2003, 4 pages.

Skrebowski, Chris, "*US Interest in North Korean Reserves,*" Petroleum, Energy Institute, Jul. 2003, 4 pages.

Zupanick, U.S. Patent Application entitled "Slant Entry Well System and Method," U.S. Appl. No. 10/004,316, Oct. 30, 2001, (WO 03/038233) (36 pages).

Zupanick, et al., U.S. Patent Application entitled "Method and System for Underground Treatment of Materials," U.S. Appl. No. 10/142,817, May 8, 2002 (WO 03/095795 A1) (55 pages).

Zupanick, U.S. Patent Application entitled "Method of Drilling Lateral Wellbores From a Slant Well Without Utilizing a Whipstock," U.S. Appl. No. 10/267,426, Oct. 8, 2002 (24 pages).

Zupanick, et al., U.S. Patent Application entitled "Method and System for Recirculating Fluid in a Well System," U.S. Appl. No. 10/457,103, Jun. 5, 2003 (41 pages).

Zupanick, U.S. Patent Application entitled "Method and System for Accessing Subterranean Deposits from the Surface and Tools Therefor," U.S. Appl. No. 10/630,345, Jul. 29, 2003 (366 pages).

Pauley, Steven, U.S. Patent Application entitled "Multi–Purpose Well Bores and Method for Accessing a Subterranean Zone From the Surface," U.S. Appl. No. 10/715,300, Nov. 17, 2003 (34 pages).

Seams, Douglas, U.S. Patent Application entitled "Method and System for Extraction of Resources from a Subterranean Well Bore," U.S. Appl. No. 10/723,322, Nov. 26, 2003 (40 pages).

Zupanick, U.S. Patent Application entitled "Slant Entry Well System and Method," U.S. Appl. No. 10/749,884, Dec. 31, 2003 (28 pages).

Zupanick, U.S. Patent Application entitled "Method and System for Accessing Subterranean Deposits from the Surface," U.S. Appl. No. 10/761,629, Jan. 20, 2004 (38 pages).

Zupanick, U.S. Patent Application entitled "Method and System for Testing A Partially Formed Hydrocarbon Well for Evaluation and Well Planning Refinement," U.S. Appl. No. 10/769,221, Jan. 30, 2004 (34 pages).

Platt, "Method and System for Lining Multilateral Wells," U.S. Appl. No. 10/772,841, Feb. 5, 2004 (30 pages).

Zupanick, "System And Method For Directional Drilling Utilizing Clutch Assembly," U.S. Appl. No. 10/811,118, Mar. 25, 2004 (35 pages).

Zupanick et al., "Slot Cavity," U.S. Appl. No. 10/419,529, Apr. 21, 2003 (44 pages).

Zupanick, "System and Method for Multiple Wells from a Common Surface Location," U.S. Appl. No. 10/788,694, Feb. 27, 2004 (26 pages).

Field, T.W., "*Surface to In–seam Drilling—The Australian Experience*," Undated, 10 pages.

Drawings included in CBM well permit issued to CNX stamped Apr. 15, 2004 by the West Virginia Department of Environmental Protection (5 pages).

Website of Mitchell Drilling Contractors, "*Services: Dymaxion—Surface to In–seam,*" http://www.mitchell drilling-.com/dymaxion.htm, printed as of Jun. 17, 2004, 4 pages.

Website of CH4, "About Natural Gas—Technology," http://www.ch4.com.au/ng_technology.html, copyright 2003, printed as of Jun. 17, 2004, 4 pages.

Thomson, et al., "*The Application of Medium Radius Directional Drilling for Coal Bed Methane Extraction,*" Lucas Technical Paper, copyrighted 2003, 11 pages.

U.S. Department of Energy, DE–FC26–01NT41148, "*Enhanced Coal Bed Methane Production and Sequestration of CO2 in Unmineable Coal Seams*" for Consol, Inc., accepted Oct. 1, 2001, 48 pages.

U.S. Department of Energy, "*Slant Hole Drilling,*" Mar. 1999, 1 page.

Desai, Praful, et al., "*Innovative Design Allows Construction of Level 3 or Level 4 Junction Using the Same Platform,*" SPE/Petroleum Society of CIM/CHOA 78965, Canadian Heavy Oil Association, 2002, pp. 1–11.

Bybee, Karen "*Advanced Openhole Multilaterals,*" Horizontal Wells, Nov. 2002, pp. 41–42.

Bybee, Karen, "*A New Generation Multilateral System for the Troll Olje Field,*" Multilateral/Extended Reach, Jul. 2002, 2 pages.

Emerson,, A.B., et al., "*Moving Toward Simpler, Highly Functional Multilateral Completions,*" Technical Note, Journal of Canadian Petroleum Technology, May 2002, vol. 41, No. 5, pp. 9–12.

Moritis, Guntis, "*Complex Well Geometries Boost Orinoco Heavy Oil Producing Rates,*" XP–000969491, Oil & Gas Journal, Feb. 28, 2000, pp. 42–46.

Themig, Dan, "*Multilateral Thinking*" New Technology Magazine, Dec. 1999, pp. 24–25.

Smith, R.C., et al., "*The Lateral Tie–Back System: The Ability to Drill and Case Multiple Laterals,*" IADC/SPE 27436, Society of Petroleum Engineers, 1994, pp. 55–64, plus Multilateral Services Profile (1 page) and Multilateral Services Specifications (1 page).

Notification of Transmittal of the International Search Report or the Declaration (PCT Rule 44.1) (3 pages) and International Search Report (4 pages) re International Application No. PCT/US 03/13954 mailed Sep. 1, 2003.

Logan, Terry L., "*Drilling Techniques for Coalbed Methane,*" Hydrocarbons From Coal, Chapter 12, Copyright 1993, Title Page, Copyright Page, pp. 269–285.

Hanes, John, "*Outbursts in Leichhardt Colliery: Lessons Learned,*" International Symposium–Cum–Workshop on Management and Control of High Gas Emissions and Outbursts in Unerground Coal Mines, Wollongong, NSW, Australia, Mar. 20–24, 1995, Title page, pp. 445–449.

Williams, Ray, et al., "*Gas Reservoir Properties for Mine Gas Emission Assessment,*" Bowen Basin Symposium 2000, pp. 325–333.

Brown, K., et al., "*New South Wales Coal Seam Methane Potential,*" Petroleum Bulletin 2, Department of Mineral Resources, Discovery 2000, Mar. 1996, pp. i–viii, 1–96.

Fipke, S., et al., "*Economical Multilateral Well Technology for Canadian Heavy Oil,*" Petroleum Society, Canadian Institute of Mining, Metallurgy & Petroleum, Paper 2002–100, to be persented in Calgary Alberta, Jun. 11–13, 2002, pp. 1–11.

PowerPoint Presentation entitled, "Horizontal Coalbed Methane Wells," by Bob Stayton, Computalog Drilling Services, date is believed to have been in 2002.

Denney, Dennis, "*Drilling Maximum–Reservoir–Contact Wells in the Shaybah Field,*" SPE 85307, pp. 60, 62–63, Oct. 20, 2003.

Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.
Brunner, D.J. and Schwoebel, J.J., "Directional Drilling for Methane Drainage and Exploration in Advance of Mining," REI Drilling Directional Underground, World Coal, 1999, 10 pages.
Thakur, P.C.,, "A History of Coalbed Methane Drainage From United States Coal Mines," 2003 SME Annual Meeting, Feb. 24–26, Cincinnati, Ohio, 4 pages.
U.S. Climate Change Technology Program, "Technology Options for the Near and Long Term," 4.1.5 Advances in Coal Mine Methane Recovery Systems, pp. 162–164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi–Seam Completion Technology," Natural Gas Quarterly, E&P, Jun. 2004, pp. 78–81.
Baiton, Nicholas, "Maximize Oil Production and Recovery," Vertizontal Brochure, received Oct. 2, 2002, 4 pages.
Dreiling, Tim, McClelland, M.L. and Bilyeu, Brad, "Horizontal & High Angle Air Drilling in the San Juan Basin, New Mexico, "Believed to be dated Apr. 1996, pp. 1–11.
Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94–09, paper to be presented Mar. 20–23, 1994, Calgary, Canada, 10 pages.
Fischer, Perry A., "What's Happening in Production," World Oil; Jun. 2001, p. 27.
Website of PTTC Network News vol. 7, 1st Quarter 2001, Table of Contents, http://www.pttc.org/../news/v7n1nn4.htm printed Apr. 25, 2003, 3 pages.
Cox, Richard J.W., "Testing Horizontal Wells While Drilling Underbalanced," Delft University of Technology, Aug. 1998, 68 pages.
McLennan, John, et al., "Underbalanced Drilling Manual," Gas Research Institute, Chicago, Illinois, GRI Reference No. GRI–97/0236, copyright 1997, 502 pages.
The Need for a Viable Multi–Seam Completion Technology for the Powder River Basin, Current Practice and Limitations, Gardes Energy Services, Inc., Believed to be 2003 (8 pages).
Langley, Diane, "Potential Impact of Microholes Is Far From Diminuitive," JPT Online, http://www.spe.org/spe/jpt/jps, Nov. 2004 (5 pages).
Consol Energy Slides, "Generating Solutions, Fueling Change," Presented at Appalachian E&P Forum, Harris Nesbitt Corp., Boston, Oct. 14, 2004 (29 pages).
Notification of Transmittal of the International Search Report and the Written Opinion of the International Searching Authority, or the Declaration (3 pages), International Search Report (3 pages), and Written Opinion of the International Searching Authority (5 pages) re International Application NO. PCT/US2000/024518 mailed Nov. 10, 2004.
Schenk, Christopher J., "Geologic Definition and Resource Assessment of Continuous (Unconventional) Gas Accumulations –the U.S. Experience," Website, http://aapg.confex.com/...//, printed No.v 16, 2004 (1 page).
U.S. Department of Interior, U.S. Geological Survey,"Characteristics of Discrete and Basin–Centered Parts of the Lower Silurian Regional Oil and Gas Accumulation, Appalachian Basin: preliminary Results From a Data Set of 25 oil and Gas Fields," U.S. Geological Survey Open–File Report 98–216, Website, http://pubs.usgs.gov/of/1998/of98–216/intol.htm, printed Nov. 16, 2004 (2 pages).
Zupanick, J., "Coalbed Methane Extraction," 28th Mineral Law Conference, Lexington Kentucky, Oct. 16–17, 2003 (48 pages).
Zupanick, J., "CDX Gas–Pinnacle Project, Pinnacle Project," Presentation at the 2002 Fall Meeting of North American Coal Bed Methan Forum, Morgantown, West Virginia, Oct. 30, 2002 (23 pages).
Lukas, Andrew, Lucas Drilling Pty Ltd., "Technical Innovation and Engineering Xstrata –Oaky Creek Coal Pty Limited," Presentation at Coal Seam Gas & Mine Methan Conference in Brisbane, Nov. 22–23, 2004 (51 pages).
Field, Tony, Mitchell Drilling, "Let's Get Technical–Drilling Breakthroughs in Surface to In–Seam in Australia," Presentation at Coal Seam Gas & Mine Methan Conference in Brisbane, Nov. 22–231 2004 (9920 pages).
Zupanick, Joseph A, "Coal Mine Methan Drainage Utilizing Multilateral Horizontal Wells," 2005 SME Annual Meeting & Exhibit, Feb. 28 –Mar. 2, 2005, Salt Lake City, Utah (6 pages).
The Officical Newsletter of the Cooperative Research Centre for Mining Technology and Equipment, CMTE News 7, "Tight–Radius Drilling Clinches Award, " Jun. 2001, 1 page.
Listing of 174 References received from Third Party on Feb. 16, 2005 (9 pages).
Gardes Directional Drilling, "Multiple Directional Wells From Single Borehole Developed," Reprinted from Jul. 1989 edition of Offshore, Copyright 1989 by Penn Well Publishing Company (4 pages).
"Economic Justification and Modeling of Multilateral Wells," Economic Analysis, Hart's Petroleum Engineer International, 1997 (4 pages).
Mike Chambers, "Multi–Lateral Completions at Mobil Past, Present, and Future," presented at the 1998 Summit on E&P Drilling Technologies, Strategic Research Institute, Aug. 18–19, 1998 in San Antonio, Texas (26 pages).
David C. Oyler and William P. Diamon, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).
P. Corlay, D. Bossie–Codreanu, J.C. Sabathier and E.R Delamaide, "Improving Reservoir Management With Complex Well Architectures," Field Production & Reservoir Management, World OIl, Jan. 1997 (5 pages).
Eric R. Skonberg and Hugh W. O'Donnell, "Horizontal Drilling for Underground Coal Gasification" presented at the Eighth Underground Coal Conversion Symposium, Keystone, Colorado, Aug. 16, 1982 (8 pages).
Gamal Ismail, A.S. Fada'1, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).

C.M. Matthews and L.J. Dunn, "Drilling and Production Practices to Mitigate Sucker Rod/Tubing Wear–Related Failures in Directional Wells," SPE 22852, Society of Petroleum Engineers, Oct. 1991 (12 pages).
H.H. Fields, Stephen Krickovic, Albert Sainato, and M.G. Zabetakis, "Degasification of Virgin Pittsburgh Coalbed Through a Large Borehole," RI–7800, Bureau of Mines Report of Investigations/1973, United States Department of the Interior, 1973 (31 pages).
William P. Diamond, "Methane Control for Underground Coal Mines," IC–9395, Bureau of Mines Information Circular, United States Department of the Interior, 1994 (51 pages).
Technology Scene Drilling & Intervention Services, "Weatherford Moves Into Advanced Multilateral Well Completion Technology" and "Productivity Gains and Safety Record Speed Acceptance of UBS," *Reservoir Mechanics*, Weatherford International, Inc., 2000 Annual Report (2 pages).
"A Different Direction for CBM Wells," *W Magazine*, 2004 Third Quarter (5 pages).
Snyder, Robert E., "What's New in Production," *WorldOil Magazine*, Feb. 2005, [printed from the internet on Apr. 7, 2005], http://www.worldoil.com/magazine/Magazine Detail.asp? ART ID=2507@Month Year (3 pages).
Nazzal, Greg, "Moving Multilateral Systems to the Next Level, Strategic Acquisition Expands Weatherford's Capabilities," 2000 (2 pages).
Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).
Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.
King, Robert F., "Drilling Sideways–A Review of Horizontal Well Technology and Its Domestic Application,"DOE/ELA–TR–0565, U.S. Department of Energy, Apr. 1993, 30 pages.
Santos, Helio, SPE, Impace Engineering Solutions and Jesus Olaya, Ecopetrol/ICP, "*No–Damage Drilling: How to Achieve this Challenging Goal*?," SPE 77189, Copyright 2002, presented at the IADC/SPE Asia Pacific Drilling Technology, Jakarta, Indonesia, Sep. 9–11/2002, 10 pages.
Santos, Helio, SPE, Impact Engineering Solutions, "*Increasing Leakoff Pressure with New Class of Drilling Fluid,*" SPE 78243, Copyright 2002, presented at the SPE/ISRM Rock Mechanics Conference in Irving, Texas, Oct. 20–23/2002. 7 pages.
Franck Labenski, Paul Reid, SPE, and Helio Santos, SPE, Impact Solutions Group, "Drilling Fluids Approaches for Control of Wellbore Instability in Fractured Formation," SPE/IADC 85304, Society of Petroleum Engineers, Copyright 2003, presented at the SPE/IADC Middle East Drilling Technology Conference & Exhibition in Abu Chabi, UAE, Oct. 20–22/2003, 8 pages.
P. Reid, SPE, and H. Santos, SPE, Impact Solutions Group, "Novel Drilling, Completion and Workover Fluids for Depleted Zones: Avoiding Losses, Formation Damage and Struck Pipe,"SPE/IADC 85326, Society of Petroleum Engineers, Copyright 2003, presented at the SPE/IADC Middle East Drilling Conference & Exhibition in Abu Chabi, UAE, Oct. 20–22/2003, 9 pages.
Craig C . White and Adrian P. Chesters, NAM Catalin D. Ivan, Sven Maikranz and Rob NOuris, M–I L.L.C., "Aphron–based drilling fluid: Novel technology for drilling depleted formations," World Oil, Drilling Report Special Focus, Oct. 2003, 5 pages.
Robert E. Synder, "Drilling Advances," World Oil, Oct. 2003, 1 page.
U.S. Environmental Protection Agency, "Directional Drilling Technology," prepared for the EPA by Advanced Resources International under Contract 68 –W–00–094, Coalbed Methane Outreach Program (CMOP), Website: htttp://search.epa.gov/s97is.vts, printed Mar. 17, 2005, 13 pages.
"Meridian Tests New Technology," Western Oil World, Jun. 1990, Cover, Table of Contents and p. 13.
Clint Leazer and Michael R. Marquez, "Short–Radius Drilling Expands Horizontal Well Applications,"Petroleum Engineer International, Apr. 1995, 6 pages.
Terry R. Logan, "Horizontal Drainhole Drilling Techniques Used in Rocky Mountains Coal Steams," Geology and Coal–Bed Methane Resources of the Northern San Juan Basin, Colorado and New Mexico, Rocky mountain Association of Geologists, Coal–Bed Methane, San Juan Basin, 1988, pp. cover, 133–142.

* cited by examiner

METHOD AND SYSTEM FOR ACCESSING A SUBTERRANEAN ZONE FROM A LIMITED SURFACE AREA

RELATED APPLICATION

This application is a continuation of U.S. application Ser. No. 09/774,996 filed Jan. 30, 2001 and entitled "Method and System for Accessing a Subterranean Zone from a Limited Surface Area" by Joseph A. Zupanick et al, now U.S. Pat. No. 6,662,870.

TECHNICAL FIELD OF THE INVENTION

The present invention relates generally to the field of subterranean exploration and drilling and, more particularly, to a method and system for accessing a subterranean zone from a limited surface area.

BACKGROUND OF THE INVENTION

Subterranean deposits of coal, whether of "hard" coal such as anthracite or "soft" coal such as lignite or bituminous coal, contain substantial quantities of entrained methane gas. Limited production and use of methane gas from coal deposits has occurred for many years. Substantial obstacles have frustrated more extensive development and use of methane gas deposits in coal seams. The foremost problem in producing methane gas from coal seams is that while coal seams may extend over large areas, up to several thousand acres, the coal seams are fairly shallow in depth, varying from a few inches to several meters. Thus, while the coal seams are often relatively near the surface, vertical wells drilled into the coal deposits for obtaining methane gas can only drain a fairly small radius around the coal deposits. Further, coal deposits are not amenable to pressure fracturing and other methods often used for increasing methane gas production from rock formations. As a result, once the gas easily drained from a vertical well bore in a coal seam is produced, further production is limited in volume. Additionally, coal seams are often associated with subterranean water, which must be drained from the coal seam in order to produce the methane.

Prior systems and methods generally require a fairly level surface area from which to work. As a result, prior systems and methods generally cannot be used in Appalachia or other hilly terrains. For example, in some areas the largest area of flat land may be a wide roadway. Thus, less effective methods must be used, leading to production delays that add to the expense associated with degasifying a coal seam. Additionally, prior systems and methods generally require fairly large working surface area. Thus, many subterranean resources are inaccessible because of current mining techniques and the geographic limitations surrounding the resource. Additionally, potential disruption or devastation to the environment surrounding the subterranean resources often prevents the mining of many subterranean resources.

SUMMARY OF THE INVENTION

The present invention provides a method and system for accessing subterranean deposits from a limited surface area that substantially eliminates or reduces the disadvantages and problems associated with previous systems and methods.

In accordance with one embodiment of the present invention, a system for accessing a subsurface formation from a limited surface area includes a first well bore extending from the surface to a target zone. The first well bore includes an angled portion disposed between the target zone and the surface. The system also includes a second well bore extending from the surface to the target zone. The second well bore is offset from the first well bore at the surface and intersects the first well bore at a junction proximate the target zone. The system further includes a well bore pattern extending from the junction into the target zone.

In accordance with another embodiment of the present invention, a method for accessing a subsurface formation from a limited surface area includes forming a first well bore extending from the surface to a target zone. The first well bore includes an angled portion disposed between the target zone and the surface. The method also includes forming a second well bore extending from the surface to the target zone.

The second well bore is offset from the first well bore at the surface and intersects the first well bore at a junction proximate the target zone. The method further includes forming a well bore pattern extending from the junction into the target zone.

Technical advantages of the present invention include providing an improved method and system for accessing subterranean deposits from a limited area on the surface. In particular, a well bore pattern is drilled in a target zone from an articulated surface well at least in close proximity to another or second surface well. The second surface well includes an angled portion to accommodate location of the second surface well in close proximity to the articulated well while providing an adequate distance at the target zone between the second surface well and the articulated well to accommodate the radius of the articulated well. The well bore pattern is interconnected to the second surface well through which entrained water, hydrocarbons, and other fluids drained from the target zone can be efficiently removed and/or produced. The well bore pattern may also be used to inject or introduce a fluid or substance into the subterranean formation. As a result, gas, oil, and other fluids from a large, low pressure or low porosity formation can be efficiently produced at a limited area on the surface. Thus, gas may be recovered from formations underlying rough topology. In addition, environmental impact is minimized as the area to be cleared and used is minimized.

Yet another technical advantage of the present invention includes providing an improved method and system for preparing a coal seam or other subterranean deposit for mining and for collecting gas from the seam after mining operations. In particular, a surface well, with a vertical portion, an articulated portion, and a cavity, is used to degasify a coal seam prior to mining operations. This reduces both needed surface area and underground equipment and activities. This also reduces the time needed to degasify the seam, which minimizes shutdowns due to high gas content. In addition, water and additives may be pumped into the de-gasified coal seam through the combined well prior to mining operations to minimize dust and other hazardous conditions, to improve efficiency of the mining process, and to improve the quality of the coal product. After mining, the combined well is used to collect gob gas. As a result, costs associated with the collection of gob gas are minimized to facilitate or make feasible the collection of gob gas from previously mined seams.

Other technical advantages of the present invention will be readily apparent to one skilled in the art from the following figures, description, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
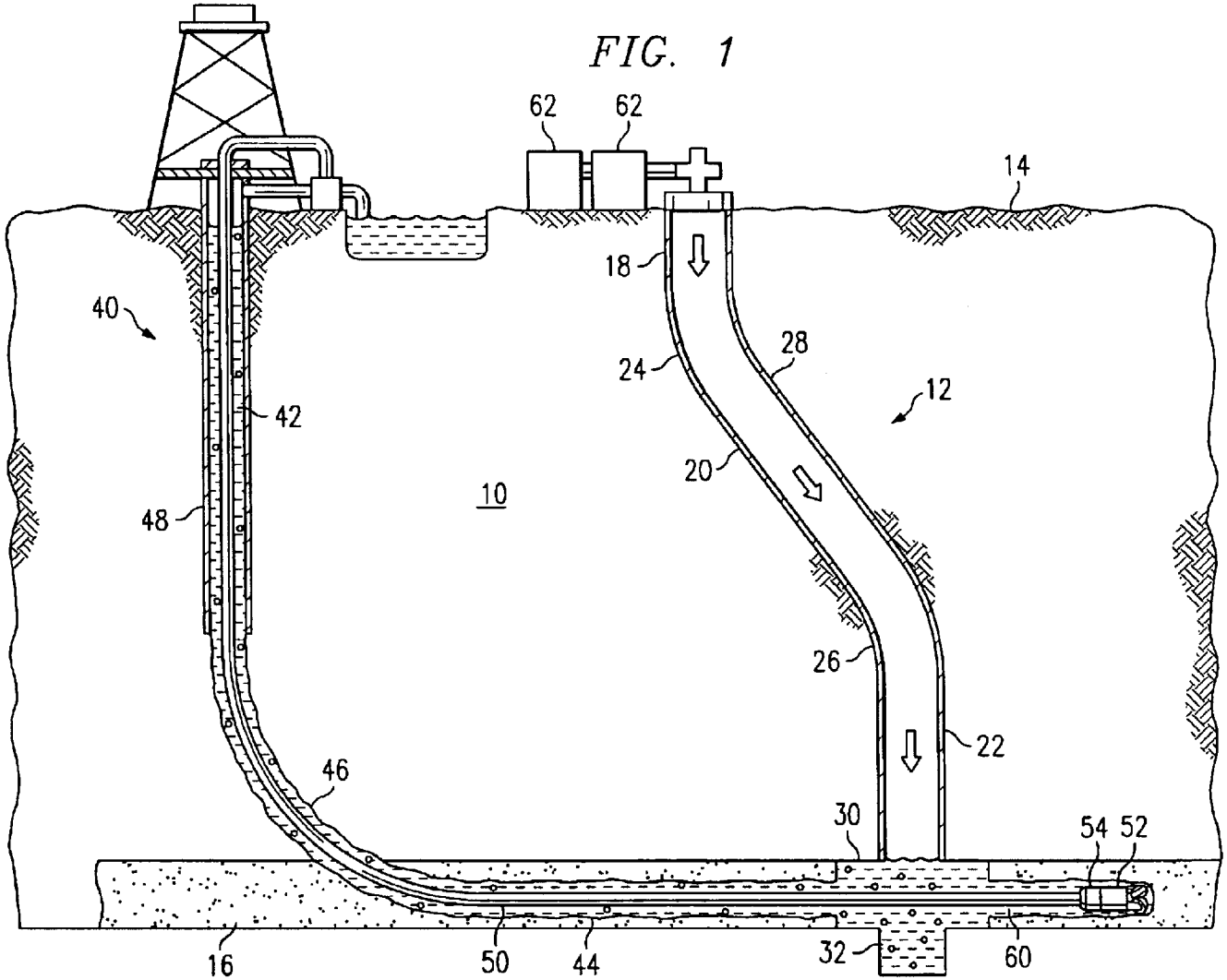
FIG. 1 is a cross-sectional diagram illustrating a system for accessing a subterranean zone from a limited surface area in accordance with an embodiment of the present invention.

FIG. 1 is a diagram illustrating a system 10 for accessing a subterranean zone from a limited surface area in accordance with an embodiment of the present invention. In this embodiment, the subterranean zone is a coal seam. However, it should be understood that other subterranean formations and/or other low pressure, ultra-low pressure, and low porosity subterranean zones can be similarly accessed using the system 10 of the present invention to remove and/or produce water, hydrocarbons and other fluids in the zone, to treat minerals in the zone prior to mining operations, or to inject, introduce, or store a gas, fluid or other substance into the zone.

Referring to FIG. 1, a well bore 12 extends from the surface 14 to a target coal seam 16. The well bore 12 intersects, penetrates and continues below the coal seam 16. In the embodiment illustrated in FIG. 1, the well bore 12 includes a portion 18, an angled portion 20, and a portion 22 disposed between the surface 14 and the coal seam 16. IN FIG. 1, portions 18 and 22 are illustrated substantially vertical; however, it should be understood that portions 18 and 22 may be formed at other suitable angles and orientations to accommodate surface 14 and/or coal seam 16 variations.

In this embodiment, the portion 18 extends downwardly in a substantially vertical direction from the surface 14 a predetermined distance to accommodate formation of radiused portions 24 and 26, angled portion 20, and portion 22 to intersect the coal seam 16 at a desired location. Angled portion 20 extends from an end of the portion 18 and extends downwardly at a predetermined angle relative to the portion 18 to accommodate intersection of the coal seam 16 at the desired location. Angled portion 20 may be formed having a generally uniform or straight directional configuration or may include various undulations or radiused portions as required to intersect portion 22 and/or to accommodate various subterranean obstacles, drilling requirements or characteristics. Portion 22 extends downwardly in a substantially vertical direction from an end of the angled portion 20 to intersect, penetrate and continue below the coal seam 16.

In one embodiment, to intersect a coal seam 16 located at a depth of approximately 1200 feet below the surface 14, the portion 18 may be drilled to a depth of approximately 300 feet. Radiused portions 24 and 26 may be formed having a radius of approximately 400 feet, and angled portion 20 may be tangentially formed between radiused portions 24 and 26 at an angle relative to the portion 18 to accommodate approximately a 250 foot offset between portions 18 and 22 at a depth of approximately 200 feet above the target coal seam 16. The portion 22 may be formed extending downwardly the remaining 200 feet to the coal seam 16. However, other suitable drilling depths, drilling radii, angular orientations, and offset distances may be used to form well bore 12. The well bore 12 may also be lined with a suitable well casing 28 that terminates at or above the upper level of the coal seam 16.

The well bore 12 is logged either during or after drilling in order to locate the exact vertical depth of the coal seam 16. As a result, the coal seam 16 is not missed in subsequent drilling operations, and techniques used to locate the coal seam 16 while drilling need not be employed. An enlarged cavity 30 is formed in the well bore 12 at the level of the coal seam 16. As described in more detail below, the enlarged cavity 30 provides a junction for intersection of the well bore 12 by an articulated well bore used to form a subterranean well bore pattern in the coal seam 16. The enlarged cavity 30 also provides a collection point for fluids drained from the coal seam 16 during production operations. In one embodiment, the enlarged cavity 30 has a radius of approximately eight feet and a vertical dimension which equals or exceeds the vertical dimension of the coal seam 16. The enlarged cavity 30 is formed using suitable under-reaming techniques and equipment. Portion 22 of the well bore 12 continues below the enlarged cavity 30 to form a sump 32 for the cavity 30.

An articulated well bore 40 extends from the surface 14 to the enlarged cavity 30. In this embodiment, the articulated well bore 40 includes a portion 42, a portion 44, and a curved or radiused portion 46 interconnecting the portions 42 and 44. The portion 44 lies substantially in the plane of the coal seam 16 and intersects the enlarged cavity 30. In FIG. 1, portion 42 is illustrated substantially vertical, and portion 44 is illustrated substantially horizontal; however, it should be understood that portions 42 and 44 may be formed having other suitable orientations to accommodate surface 14 and/or coal seam 16 characteristics.

In the illustrated embodiment, the articulated well bore 40 is offset a sufficient distance from the well bore 12 at the surface 14 to permit the large radius curved portion 46 and any desired distance of portion 44 to be drilled before intersecting the enlarged cavity 30. In one embodiment, to provide the curved portion 46 with a radius of 100–150 feet, the articulated well bore 40 is offset a distance of approximately 300 feet from the well bore 12 at the surface 14. This spacing minimizes the angle of the curved portion 46 to reduce friction in the articulated well bore 40 during drilling operations. As a result, reach of the articulated drill string drilled through the articulated well bore 40 is maximized. However, other suitable offset distances and radii may be used for forming the articulated well bore 40. The portion 42 of the articulated well bore 40 is lined with a suitable casing 48.

The articulated well bore 40 is drilled using an articulated drill string 50 that includes a suitable down-hole motor and bit 52. A measurement while drilling (MWD) device 54 is included in the articulated drill string 50 for controlling the orientation and direction of the well bore drilled by the motor and bit 52.

After the enlarged cavity 30 has been successfully intersected by the articulated well bore 40, drilling is continued through the cavity 30 using the articulated drill string 50 and appropriate drilling apparatus to provide a subterranean well bore pattern 60 in the coal seam 16. The well bore pattern 60 and other such well bores include sloped, undulating, or other inclinations of the coal seam 16 or other subterranean zone. During this operation, gamma ray logging tools and conventional measurement while drilling devices may be employed to control and direct the orientation of the drill bit 52 to retain the well bore pattern 60 within the confines of the coal seam 16 and to provide substantially uniform coverage of a desired area within the coal seam 16.

During the process of drilling the well bore pattern 60, drilling fluid or "mud" is pumped down the articulated drill string 50 and circulated out of the drill string 50 in the vicinity of the bit 52, where it is used to scour the formation and to remove formation cuttings. The cuttings are then entrained in the drilling fluid which circulates up through the annulus between the drill string 50 and the walls of the articulated well bore 40 until it reaches the surface 14, where the cuttings are removed from the drilling fluid and the fluid is then recirculated. This conventional drilling operation produces a standard column of drilling fluid having a vertical height equal to the depth of the articulated well bore 40 and produces a hydrostatic pressure on the well bore corresponding to the well bore depth. Because coal seams tend to be porous and fractured, they may be unable to sustain such hydrostatic pressure, even if formation water is also present in the coal seam 16. Accordingly, if the full hydrostatic pressure is allowed to act on the coal seam 16, the result may be loss of drilling fluid and entrained cuttings into the formation. Such a circumstance is referred to as an "over-balanced" drilling operation in which the hydrostatic fluid pressure in the well bore exceeds the ability of the formation to withstand the pressure. Loss of drilling fluids and cuttings into the formation not only is expensive in terms of the lost drilling fluids, which must be made up, but it also tends to plug the pores in the coal seam 16, which are needed to drain the coal seam of gas and water.

To prevent over-balance drilling conditions during formation of the well bore pattern 60, air compressors 62 are provided to circulate compressed air down the well bore 12 and back up through the articulated well bore 40. The circulated air will admix with the drilling fluids in the annulus around the articulated drill string 50 and create bubbles throughout the column of drilling fluid. This has the effect of lightening the hydrostatic pressure of the drilling fluid and reducing the down-hole pressure sufficiently that drilling conditions do not become over-balanced. Aeration of the drilling fluid reduces down-hole pressure to approximately 150–200 pounds per square inch (psi). Accordingly, low pressure coal seams and other subterranean zones can be drilled without substantial loss of drilling fluid and contamination of the zone by the drilling fluid.

Foam, which may be compressed air mixed with water, may also be circulated down through the articulated drill string 50 along with the drilling mud in order to aerate the drilling fluid in the annulus as the articulated well bore 40 is being drilled and, if desired, as the well bore pattern 60 is being drilled. Drilling of the well bore pattern 60 with the use of an air hammer bit or an air-powered down-hole motor will also supply compressed air or foam to the drilling fluid. In this case, the compressed air or foam which is used to power the down-hole motor and bit 52 exits the articulated drill string 50 in the vicinity of the drill bit 52. However, the larger volume of air which can be circulated down the well bore 12 permits greater aeration of the drilling fluid than generally is possible by air supplied through the articulated drill string 50.

Figure 2:
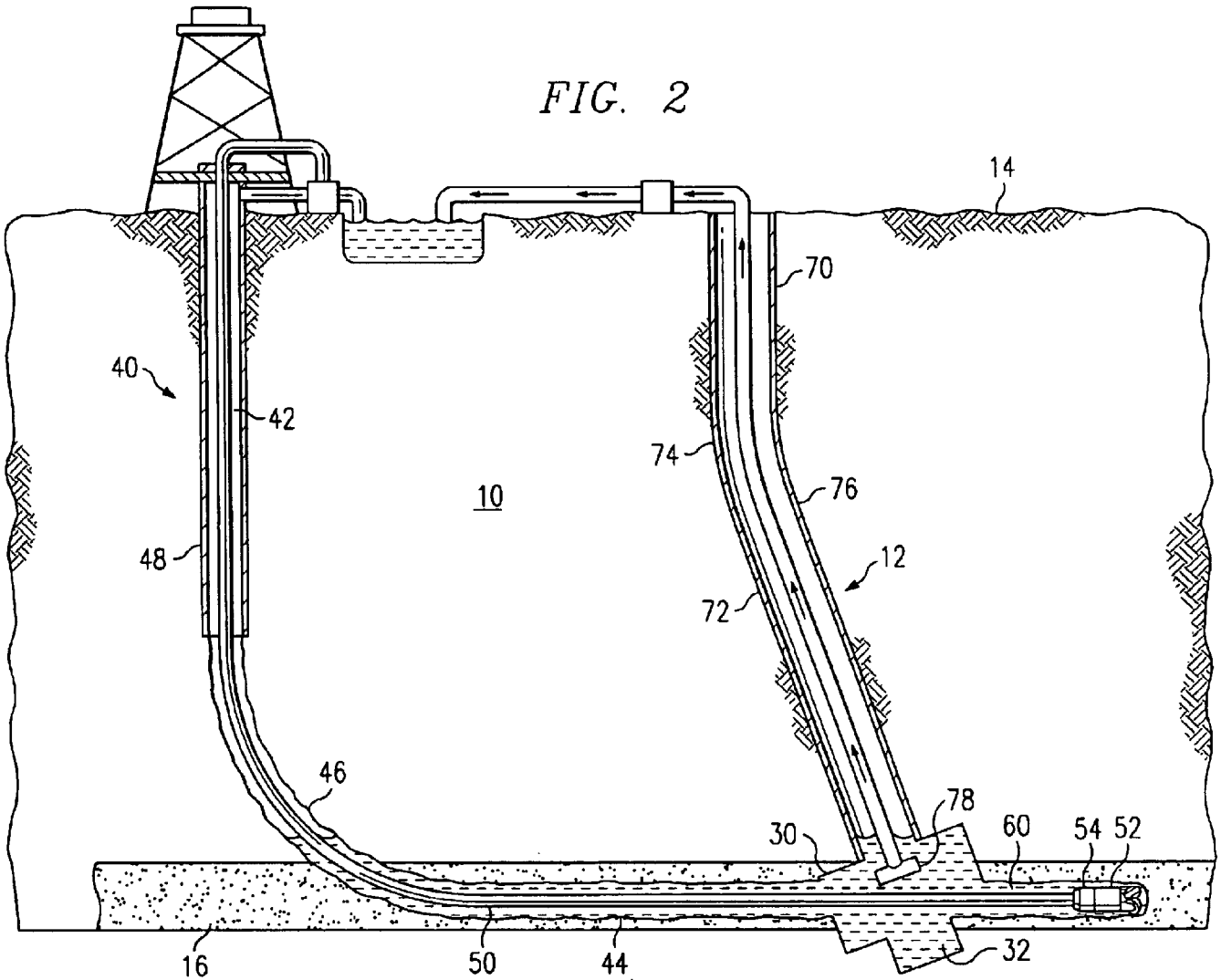
FIG. 2 is a cross-sectional diagram illustrating a system for accessing a subterranean zone from a limited surface area in accordance with another embodiment of the present invention.

FIG. 2 is a diagram illustrating system 10 for accessing a subterranean zone from a limited surface area in accordance with another embodiment of the present invention. In this embodiment, the articulated well bore 40 is formed as previously described in connection with FIG. 1. The well bore 12, in this embodiment, includes a portion 70 and an angled portion 72 disposed between the surface 14 and the coal seam 16. The portion 70 extends downwardly from the surface 14 a predetermined distance to accommodate formation of a radiused portion 74 and angled portion 72 to intersect the coal seam 16 at a desired location. In this embodiment, portion 70 is illustrated substantially vertical; however, it should be understood that portion 70 may be formed at other suitable orientations to accommodate surface 14 and/or coal seam 16 characteristics. Angled portion 72 extends from an end of the portion 70 and extends downwardly at a predetermined angle relative to portion 70 to accommodate intersection of the coal seam 16 at the desired location. Angled portion 72 may be formed having a generally uniform or straight directional configuration or may include various undulations or radiused portions as required to intersect the coal seam 16 at a desired location and/or to accommodate various subterranean obstacles, drilling requirements or characteristics.

In one embodiment, to intersect a coal seam 16 located at a depth of approximately 1200 feet below the surface 14, the portion 70 may be drilled to a depth of approximately 300 feet. Radiused portion 74 may be formed having a radius of approximately 400 feet, and angled portion 72 may be tangentially formed in communication with the radiused portion 74 at an angle relative to the portion 70 to accommodate approximately a 300 foot offset between the portion 70 and the intersection of the angled portion 72 at the target coal seam 16. However, other suitable drilling depths, drilling radii, angular orientations, and offset distances may be used to form well bore 12. The well bore 12 may also be lined with a suitable well casing 76 that terminates at or above the upper level of the coal seam 16.

The well bore 12 is logged either during or after drilling in order to locate the exact depth of the coal seam 16. As a result, the coal seam 16 is not missed in subsequent drilling operations, and techniques used to locate the coal seam 16 while drilling need not be employed. The enlarged cavity 30 is formed in the well bore 12 at the level of the coal seam 16 as previously described in connection with FIG. 1. However, as illustrated in FIG. 2, because of the angled portion 72 of the well bore 12, the enlarged cavity 30 may be disposed at an angle relative to the coal seam 16. As described above, the enlarged cavity 30 provides a junction for intersection of the well bore 12 and the articulated well bore 40 to provide a collection point for fluids drained from the coal seam 16 during production operations. Thus, depending on the angular orientation of the angled portion 72, the radius and/or vertical dimension of the enlarged cavity 30 may be modified such that portions of the enlarged cavity 30 equal or exceed the vertical dimension of the coal seam 16. Angled portion 72 of the well bore 12 continues below the enlarged cavity 30 to form a sump 32 for the cavity 30.

After intersection of the enlarged cavity 30 by the articulated well bore 40, a pumping unit 78 is installed in the enlarged cavity 30 to pump drilling fluid and cuttings to the surface 14 through the well bore 12. This eliminates the friction of air and fluid returning up the articulated well bore 40 and reduces down-hole pressure to nearly zero. Pumping unit 78 may include a sucker rod pump, a submersible pump, a progressing cavity pump, or other suitable pumping device for removing drilling fluid and cuttings to the surface 14. Accordingly, coal seams and other subterranean zones having ultra low pressures, such as below 150 psi, can be accessed from the surface. Additionally, the risk of combining air and methane in the well is substantially eliminated.

Figure 3:
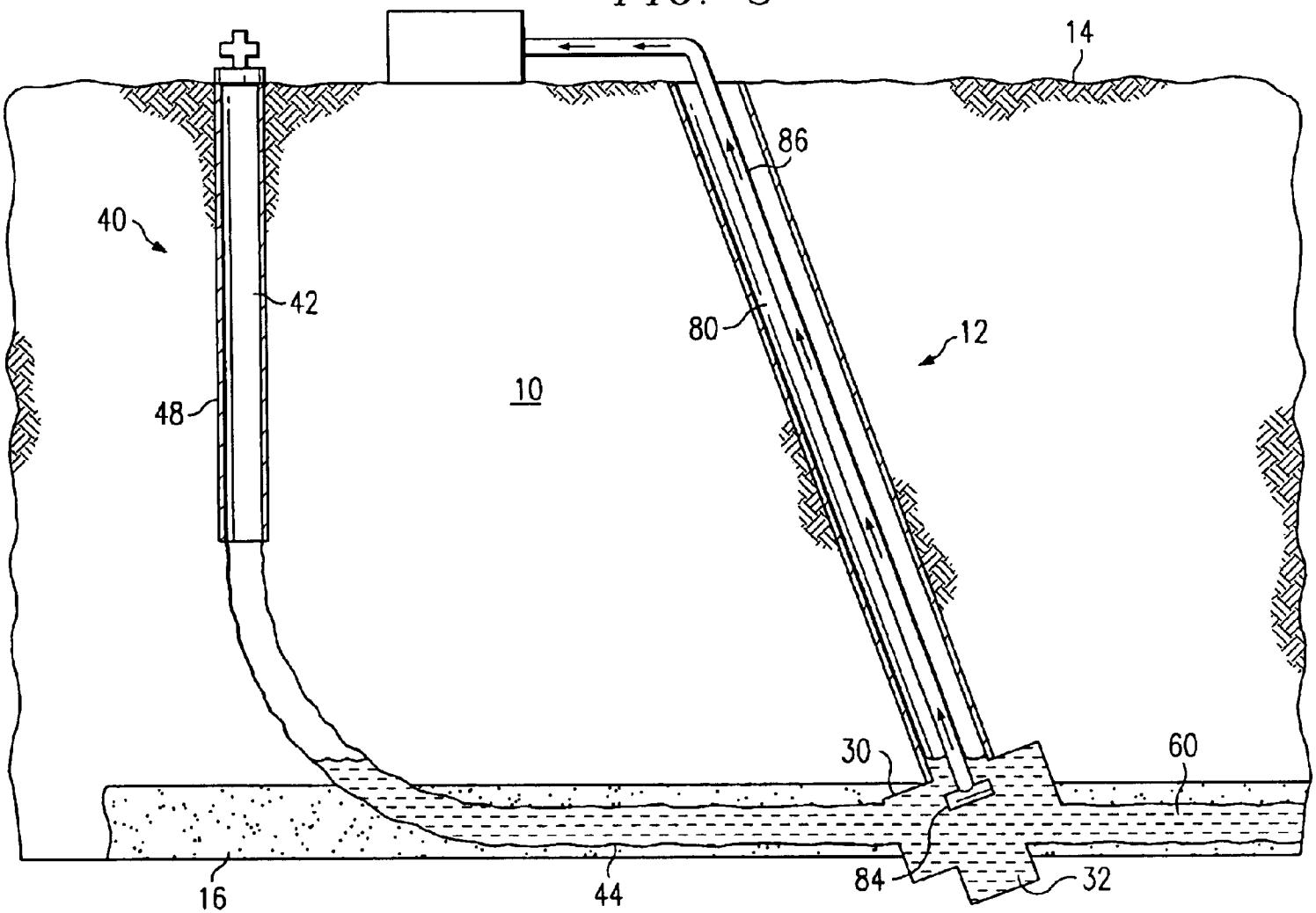
FIG. 3 is a cross-sectional diagram illustrating a system for accessing a subterranean zone from a limited surface area in accordance with another embodiment of the present invention.

FIG. 3 is a diagram illustrating system 10 for accessing a subterranean zone from a limited surface area in accordance with another embodiment of the present invention. In this embodiment, the articulated well bore 40 is formed as previously described in connection with FIG. 1. The well bore 12, in this embodiment, includes an angled portion 80 disposed between the surface 14 and the coal seam 16. For example, in this embodiment, the angled portion 80 extends downwardly from the surface 14 at a predetermined angular orientation to intersect the coal seam 16 at a desired location. Angled portion 80 may be formed having a generally uniform or straight directional configuration or may include various undulations or radiused portions as required to intersect the coal seam 16 at a desired location and/or to accommodate various subterranean obstacles, drilling requirements or characteristics.

In one embodiment, to intersect a coal seam 16 located at a depth of approximately 1200 feet below the surface 14, the angled portion 80 may be drilled at an angle of approximately 20 degrees from vertical to accommodate approximately a 440 foot offset between the surface 14 location of the angled portion 80 and the intersection of the angled portion 80 at the target coal seam 16. However, other suitable angular orientations and offset distances may be used to form angled portion 80 of well bore 12. The well bore 12 may also be lined with a suitable well casing 82 that terminates at or above the upper level of the coal seam 16.

The well bore 12 is logged either during or after drilling in order to locate the exact depth of the coal seam 16. As a result, the coal seam 16 is not missed in subsequent drilling operations, and techniques used to locate the coal seam 16 while drilling need not be employed. The enlarged cavity 30 is formed in the well bore 12 at the level of the coal seam 16 as previously described in connection with FIG. 1. However, as illustrated in FIG. 2, because of the angled portion 80 of the well bore 12, the enlarged cavity 30 may be disposed at an angle relative to the coal seam 16. As described above, the enlarged cavity 30 provides a junction for intersection of the well bore 12 and the articulated well bore 40 to provide a collection point for fluids drained from the coal seam 16 during production operations. Thus, depending on the angular orientation of the angled portion 80, the radius and/or vertical dimension of the enlarged cavity 30 may be modified such that portions of the enlarged cavity 30 equal or exceed the vertical dimension of the coal seam 16. Angled portion 80 of the well bore 12 continues below the enlarged cavity 30 to form a sump 32 for the cavity 30.

After the well bore 12, articulated well bore 40, enlarged cavity 30 and the desired well bore pattern 60 have been formed, the articulated drill string 50 is removed from the articulated well bore 40 and the articulated well bore 40 is capped. A down hole production or pumping unit 84 is disposed in the well bore 12 in the enlarged cavity 30. The enlarged cavity 30 provides a reservoir for accumulated fluids allowing intermittent pumping without adverse effects of a hydrostatic head caused by accumulated fluids in the well bore. Pumping unit 84 may include a sucker rod pump, a submersible pump, a progressing cavity pump, or other suitable pumping device for removing accumulated fluids to the surface.

The down hole pumping unit 84 is connected to the surface 14 via a tubing string 86. The down hole pumping unit 84 is used to remove water and entrained coal fines from the coal seam 16 via the well bore pattern 60. Once the water is removed to the surface 14, it may be treated for separation of methane which may be dissolved in the water and for removal of entrained fines. After sufficient water has been removed from the coal seam 16, pure coal seam gas may be allowed to flow to the surface 14 through the annulus of the well bore 12 around the tubing string 86 and removed via piping attached to a wellhead apparatus. At the surface 14, the methane is treated, compressed and pumped through a pipeline for use as a fuel in a conventional manner. The down hole pumping unit 84 may be operated continuously or as needed to remove water drained from the coal seam 16 into the enlarged diameter cavity 30.

Figure 4:
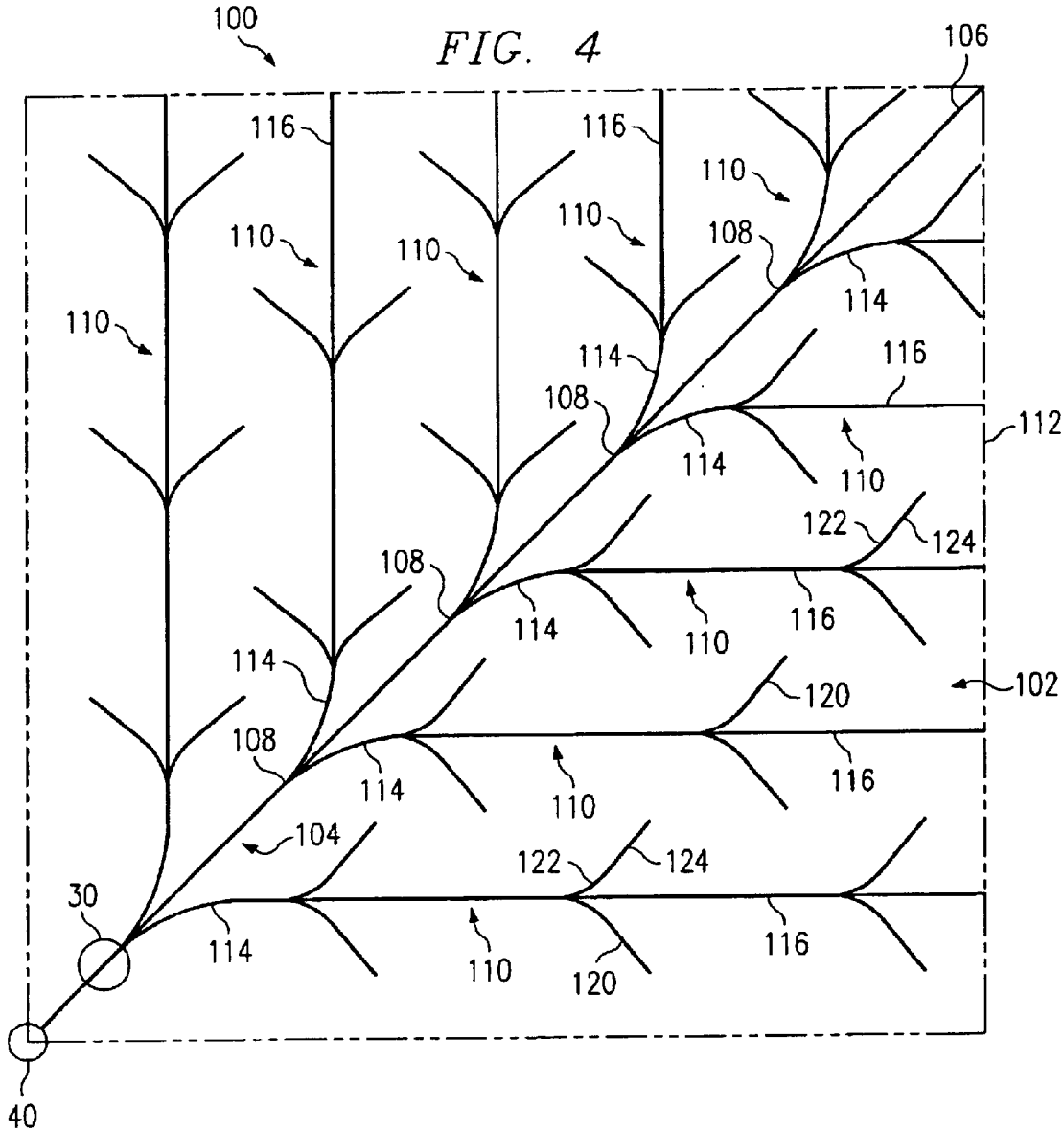
FIG. 4 is a diagram illustrating a top plan view of a pinnate well bore pattern for accessing a subterranean zone in accordance with an embodiment of the present invention.
Figure 5:
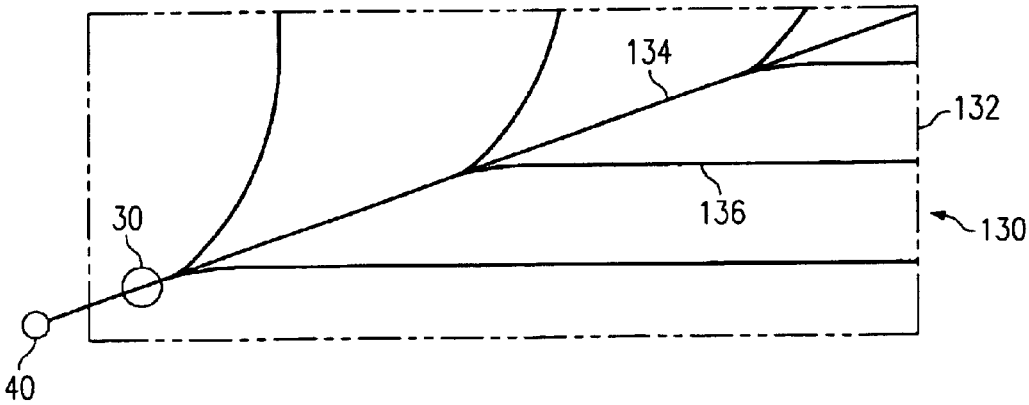
FIG. 5 is a diagram illustrating a top plan view of a pinnate well bore pattern for accessing a subterranean zone in accordance with another embodiment of the present invention.
Figure 6:
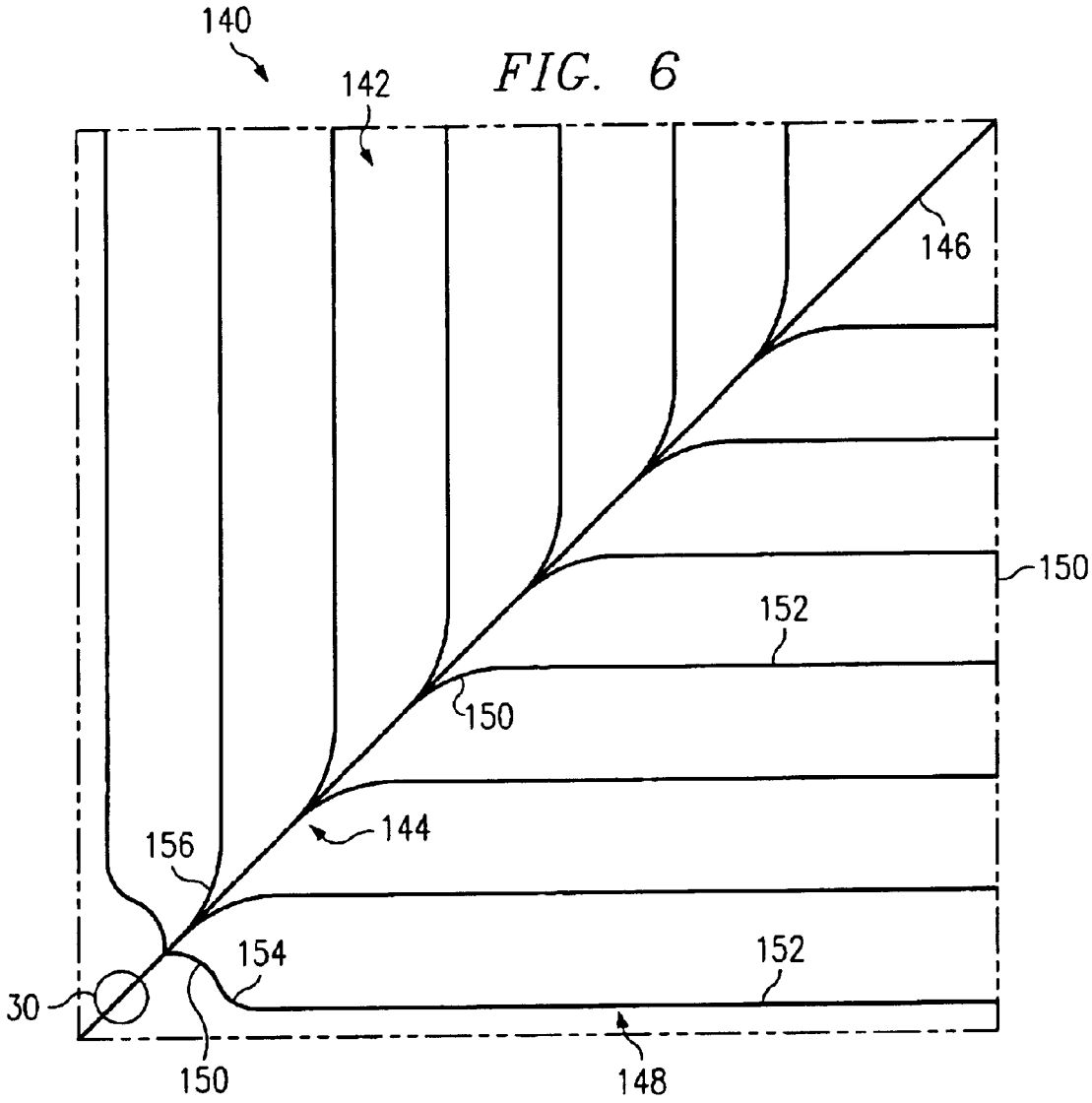
FIG. 6 is a diagram illustrating a top plan view of a pinnate well bore pattern for accessing a subterranean zone in accordance with another embodiment of the present invention.

FIGS. 4–6 are diagrams illustrating top plan views of subterranean well bore patterns 60 for accessing the coal seam 16 or other subterranean zone in accordance with embodiments of the present invention. In these embodiments, the well bore patterns 60 comprise pinnate well bore patterns that have a central or main well bore with generally symmetrically arranged and appropriately spaced lateral well bores extending from each side of the main well bore. The pinnate well bore pattern approximates the pattern of veins in a leaf or the design of a feather in that it has similar, substantially parallel, auxiliary well bores arranged in substantially equal and parallel spacing on opposite sides of an axis. The pinnate well bore pattern with its central bore and generally symmetrically arranged and appropriately spaced auxiliary well bores on each side provides a uniform pattern for accessing a subterranean formation. As described in more detail below, the pinnate well bore pattern provides substantially uniform coverage of a square, other quadrilateral, or grid area and may be aligned with longwall mining panels for preparing the coal seam 16 for mining operations. A plurality of well bore patterns may also be nested adjacent each other to provide uniform coverage of a subterranean region. It will be understood that other suitable well bore patterns may be used in accordance with the present invention.

The pinnate and other suitable well bore patterns 60 drilled from the surface 14 provide surface access to subterranean formations. The well bore pattern 60 may be used to uniformly remove and/or insert fluids or otherwise manipulate a subterranean deposit. In non-coal applications, the well bore pattern 60 may be used initiating in-situ burns, "huff-puff" steam operations for heavy crude oil, and the removal of hydrocarbons from low porosity reservoirs.

FIG. 4 is a diagram illustrating a pinnate well bore pattern 100 in accordance with one embodiment of the present invention. In this embodiment, the pinnate well bore pattern 100 provides access to a substantially square area 102 of a subterranean zone. A number of the pinnate patterns 100 may be used together to provide uniform access to a large subterranean region.

Referring to FIG. 4, the enlarged cavity 30 defines a first corner of the area 102. The pinnate well bore pattern 100 includes a main well bore 104 extending diagonally across the area 102 to a distant corner 106 of the area 102. Preferably, the well bore 12 and articulated well bore 40 are positioned over the area 102 such that the well bore 104 is drilled up the slope of the coal seam 16. This will facilitate collection of water, gas, and other fluids from the area 102. The well bore 104 is drilled using the articulated drill string 50 and extends from the enlarged cavity 30 in alignment with the articulated well bore 40.

A set of lateral well bores 110 extend from opposites sides of well bore 104 to a periphery 112 of the area 102. The lateral well bores 110 may mirror each other on opposite sides of the well bore 104 or may be offset from each other along the well bore 104. Each of the lateral well bores 110 includes a radius curving portion 114 extending from the well bore 104 and an elongated portion 116 formed after the curved portion 114 has reached a desired orientation. For uniform coverage of the square area 102, pairs of lateral well bores 110 are substantially evenly spaced on each side of the well bore 104 and extend from the well bore 104 at an angle of approximately 45 degrees. However, the lateral well bores 110 may be form at other suitable angular orientations relative to well bore 104. The lateral well bores 110 shorten in length based on progression away from the enlarged diameter cavity 30 in order to facilitate drilling of the lateral well bores 110. Additionally, as illustrated in FIG. 4, a distance to the periphery 112 of the area 102 to cavity 30 or well bores 30 or 40 measured along the lateral well bores 110 is substantially equal for each lateral well bore 110, thereby facilitating the formation of the lateral well bores 110.

The pinnate well bore pattern 100 using a single well bore 104 and five pairs of lateral bores 110 may drain a coal seam area of approximately 150 acres in size. Where a smaller area is to be drained, or where the coal seam has a different shape, such as a long, narrow shape, or due to surface or subterranean topography, alternate pinnate well bore patterns may be employed by varying the angle of the lateral well bores 110 to the well bore 104 and the orientation of the lateral well bores 110. Alternatively, lateral well bores 110 can be drilled from only one side of the well bore 104 to form a one-half pinnate well bore pattern.

The well bore 104 and the lateral well bores 110 are formed by drilling through the enlarged cavity 30 using the articulated drill string 50 and an appropriate drilling apparatus. During this operation, gamma ray logging tools and conventional measurement while drilling (MWD) technologies may be employed to control the direction and orientation of the drill bit so as to retain the well bore pattern 100 within the confines of the coal seam 16 and to maintain proper spacing and orientation of the well bore 104 and lateral well bores 110.

In a particular embodiment, the well bore 104 is drilled with an incline at each of a plurality of lateral kick-off points 108. After the well bore 104 is complete, the articulated drill string 50 is backed up to each successive lateral point 108 from which a lateral well bore 110 is drilled on each side of the well bore 104. It will be understood that the pinnate well bore pattern 100 may be otherwise suitably formed in accordance with the present invention.

In the embodiment illustrated in FIG. 4, well bore pattern 100 also includes a set of lateral well bores 120 extending from lateral well bores 110. The lateral well bores 120 may mirror each other on opposite sides of the lateral well bore 110 or may be offset from each other along the lateral well bore 110. Each of the lateral well bores 120 includes a radius curving portion 122 extending from the lateral well bore 110 and an elongated portion 124 formed after the curved portion 122 has reached a desired orientation. For uniform coverage of the area 102, pairs of lateral well bores 120 may be disposed substantially equally spaced on each side of the lateral well bore 110. Additionally, lateral well bores 120 extending from one lateral well bore 110 may be disposed to extend between lateral well bores 120 extending from an adjacent lateral well bore 110 to provide uniform coverage of the area 102. However, the quantity, spacing, and angular orientation of lateral well bores 120 may be varied to accommodate a variety of resource areas, sizes and drainage requirements.

FIG. 5 illustrates a pinnate well bore pattern 130 in accordance with another embodiment of the present invention. In this embodiment, the pinnate well bore pattern 130 provides access to a substantially rectangular area 132. The pinnate well bore pattern 130 includes a well bore 124 extending substantially diagonally from each corner of the area 132 and a plurality of lateral well bores 136 that are formed as described in connection with well bore 104 and lateral bores 110 of FIG. 4. For the substantially rectangular area 132, however, the lateral well bores 136 on a first side of the well bore 134 include a shallow angle while the lateral well bores 136 on the opposite side of the well bore 134 include a steeper angle to together provide uniform coverage of the area 132.

FIG. 6 illustrates a pinnate well bore pattern 140 in accordance with another embodiment of the present invention. In this embodiment, the enlarged cavity 30 defines a first corner of an area 142 of the zone. The pinnate well bore pattern 140 includes a well bore 144 extending diagonally across the area 142 to a distant corner 146 of the area 142. Preferably, the well bore 12 and the articulated well bore 40 are positioned over the area 142 such that the well bore 144 is drilled up the slope of the coal seam 16. This will facilitate collection of water, gas, and other fluids from the area 142. The well bore 144 is drilled using the articulated drill string 50 and extends from the enlarged cavity 30 in alignment with the articulated well bore 40.

A plurality of lateral well bores 148 extend from the opposites sides of well bore 144 to a periphery 150 of the area 142 as described above in connection with well bores 104 and 110 of FIG. 4. The lateral well bores 148 may mirror each other on opposite sides of the well bore 144 or may be offset from each other along the well bore 144. Each of the lateral well bores 148 includes a radius curving portion 150 extending from the well bore 144 and an elongated portion 152 extending from the radius curving portion 150. The elongated portion 152 is formed after the curving portion 150 has reached a desired orientation. The first set of lateral well bores 148 located proximate to the cavity 30 may also include a radius curving portion 154 formed after the curving portion 150 has reached a desired orientation. In this set, the elongated portion 152 is formed after the curving portion 154 has reached a desired orientation. Thus, the first set of lateral well bores 148 kicks or turns back towards the enlarged cavity 30 before extending outward through the formation, thereby extending the drainage area back towards the cavity 30 to provide uniform coverage of the area 142. For uniform coverage of the area 142, pairs of lateral well bores 148 are substantially evenly spaced on each side of the well bore 144 and extend from the well bore 144 at an angle of approximately 45 degrees. However, lateral well bores 148 may be formed at other angular orientations relative to the well bore 144. The lateral well bores 148 shorten in length based on progression away from the enlarged cavity 30 in order to facilitate drilling of the lateral well bores 148. Additionally, as illustrated in FIG. 6, a distance to the periphery 150 of the area 142 from the cavity 30 measured along each lateral well bore 148 is substantially equal for each lateral well bore 148, thereby facilitating the formation of lateral well bores 148.

The well bore 144 and the lateral well bores 148 are formed by drilling through the enlarged cavity 30 using the articulated drill string 50 and an appropriate drilling apparatus. During this operation, gamma ray logging tools and conventional measurement while drilling (MWD) technologies may be employed to control the direction and orientation of the drill bit so as to retain the well bore pattern 140 within the confines of the coal seam 16 and to maintain proper spacing and orientation of the well bore 144 and lateral well bores 148. In a particular embodiment, the well bore 144 is drilled with an incline at each of a plurality of lateral kick-off points 156. After the well bore 144 is complete, the articulated drill string 50 is backed up to each successive lateral point 156 from which a lateral well bore 148 is drilled on each side of the well bore 144. It should be understood that the pinnate well bore pattern 140 may be otherwise suitably formed in accordance with the present invention.

Figure 7:
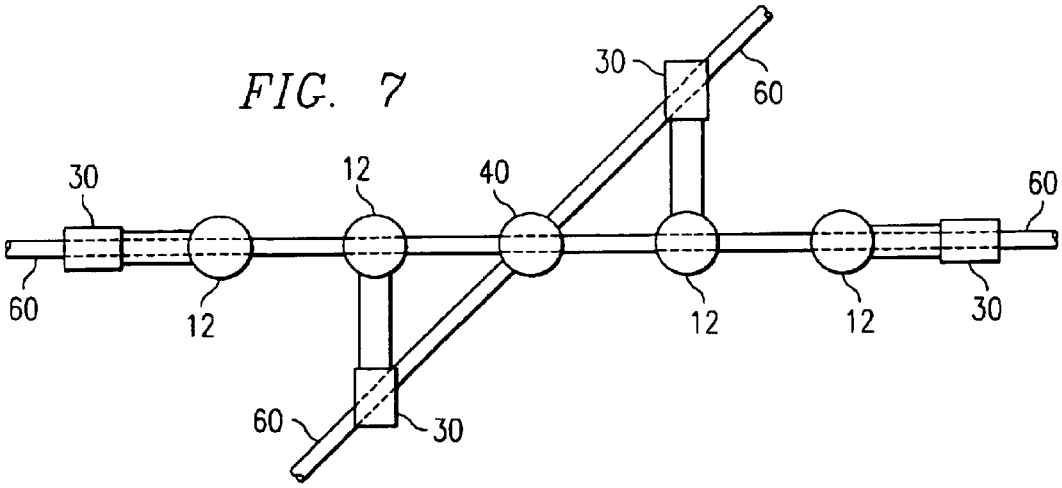
FIG. 7 is a diagram illustrating a top plan view of multiple well bore patterns in a subterranean zone through an articulated surface well intersecting multiple surface cavity wells in accordance with an embodiment of the present invention.

FIG. 7 is a diagram illustrating multiple well bore patterns in a subterranean zone through an articulated well bore 40 intersecting multiple well bores 12 in accordance with an embodiment of the present invention. In this embodiment, four well bores 12 are used to access a subterranean zone through well bore patterns 60. However, it should be understood that a varying number of well bores 12 and well bore patterns 60 may be used depending on the geometry of the underlying subterranean formation, desired access area, production requirements, and other factors.

Referring to FIG. 7, four well bores 12 are formed disposed in a spaced apart and substantially linear formation relative to each other at the surface 14. Additionally, the articulated well bore 40, in this embodiment, is disposed linearly with the well bores 12 having a pair of well bores 12 disposed on each side of the surface location of the articulated well bore 40. Thus, the well bores 12 and the articulated well bore 40 may be located over a subterranean resource in close proximity to each other and in a suitable formation to minimize the surface area required for accessing the subterranean formation. For example, according to one embodiment, each of the well bores 12 and the articulated well bore 40 may be spaced apart from each other at the surface 14 in a linear formation by approximately twenty-five feet, thereby substantially reducing the surface area required to access the subterranean resource. As a result, the well bores 12 and articulated well bore 40 may be formed on or adjacent to a roadway, steep hillside, or other limited surface area. Accordingly, environmental impact is minimized as less surface area must be cleared. Well bores 12 and 40 may also be disposed in a substantially nonlinear formation in close proximity to each other as described above to minimize the surface area required for accessing the subterranean formation.

As described above, well bores 12 are formed extending downwardly from the surface and may be configured as illustrated in FIGS. 1–3 to accommodate a desired offset distance between the surface location of each well bore 12 and the intersection of the well bore 12 with the coal seam 16 or other subterranean formation. Enlarged cavities 30 are formed proximate the coal seam 16 in each of the well bores 12, and the articulated well bore 40 is formed intersecting each of the enlarged cavities 30. In the embodiment illustrated in FIG. 7, the bottom hole location or intersection of each of the well bores 12 with the coal seam 16 is located either linearly or at a substantially ninety degree angle to the linear formation of the well bores 12 at the surface. However, the location and angular orientation of the intersection of the well bores 12 with the coal seam 16 relative to the linear formation of the well bores 12 at the surface 14 may be varied to accommodate a desired access formation or subterranean resource configuration.

Well bore patterns 60 are drilled within the target subterranean zone from the articulated well bore 40 extending from each of the enlarged cavities 30. In resource removal applications, resources from the target subterranean zone drain into each of the well bore patterns 60, where the resources are collected in the enlarged cavities 30. Once the resources have been collected in the enlarged cavities 30, the resources may be removed to the surface through the well bores 12 by the methods described above.

Figure 8:
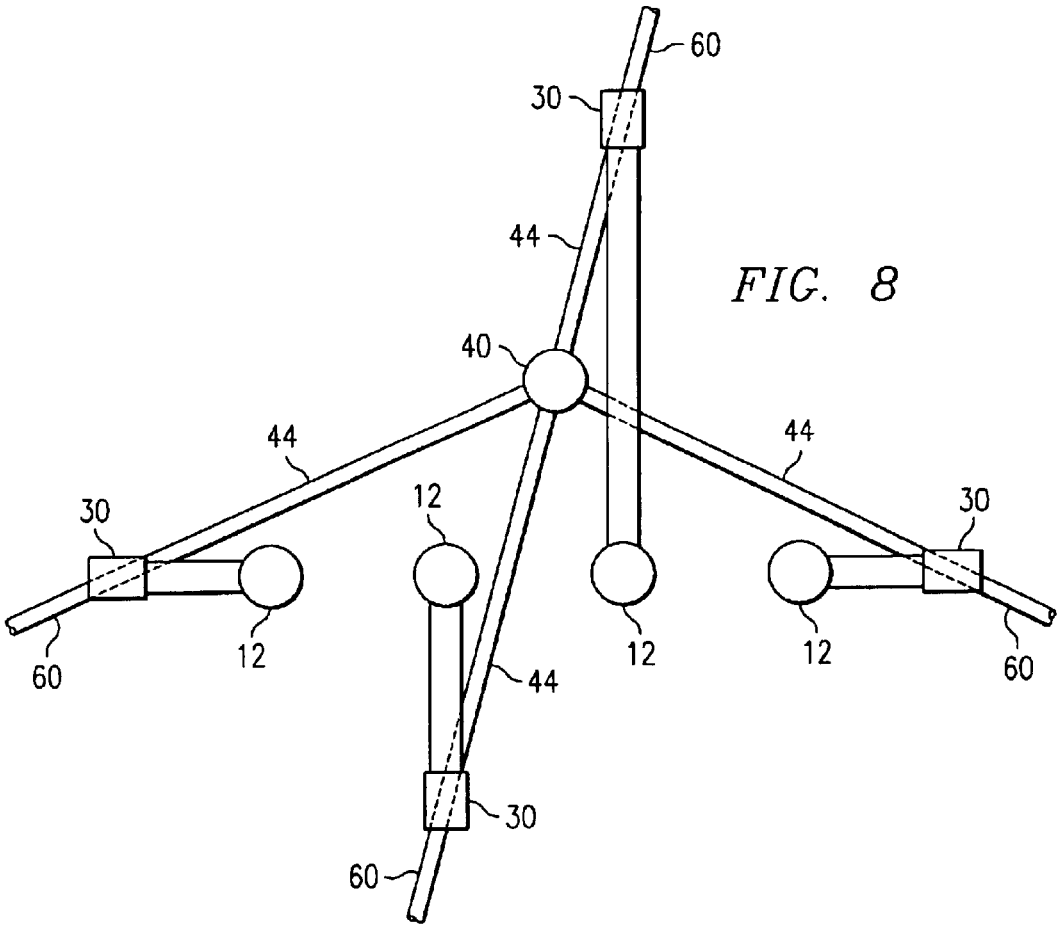
FIG. 8 is a diagram illustrating a top plan view of multiple well bore patterns in a subterranean zone through an articulated surface well intersecting multiple cavity wells in accordance with another embodiment of the present invention.

FIG. 8 is a diagram illustrating multiple horizontal well bore patterns in a subterranean zone through an articulated well bore 40 intersecting multiple well bores 12 in accordance with another embodiment of the present invention. In this embodiment, four well bores 12 are used to collect and remove to the surface 14 resources collected from well bore patterns 60. However, it should be understood that a varying number of well bores 12 and well bore patterns 60 may be used depending on the geometry of the underlying subterranean formation, desired access area, production requirements, and other factors.

Referring to FIG. 8, four well bores 12 are formed disposed in a spaced apart and substantially linear formation relative to each other at the surface 14. In this embodiment, the articulated well bore 40 is offset from and disposed adjacent to the linear formation of the well bores 12. As illustrated in FIG. 8, the articulated well bore 40 is located such that a pair of well bores 12 are disposed on each side of the articulated well bore 40 in a direction substantially orthogonal to the linear formation of well bores 12. Thus, the well bores 12 and the articulated well bore 40 may be located over a subterranean resource in close proximity to each other and in a suitable formation to minimize the surface area required for gas production and coal seam 16 treatment. For example, according to one embodiment, each of the well bores 12 may be spaced apart from each other at the surface 14 in a linear formation by approximately twenty-five feet, and the articulated well bore 40 may be spaced apart from each of the two medially-located well bores 12 by approximately twenty-five feet, thereby substantially reducing the surface area required to access the subterranean resource and for production and drilling. As a result, the well bores 12 and articulated well bore 40 may be formed on or adjacent to a roadway, steep hillside, or other limited surface area. Accordingly, environmental impact is minimized as less surface area must be cleared.

As described above, well bores 12 are formed extending downwardly from the surface and may be configured as illustrated in FIGS. 1–3 to accommodate a desired offset distance between the surface location of each well bore 12 and the intersection of the well bore 12 with the coal seam 16. Enlarged cavities 30 are formed proximate the coal seam 16 in each of the well bores 12, and the articulated well bore 40 is formed intersecting each of the enlarged cavities 30. In the embodiment illustrated in FIG. 8, the bottom hole location or intersection of each of the well bores 12 with the coal seam 16 is located either linearly or at a substantially ninety degree angle to the linear formation of the well bores 12 at the surface. However, the location and angular orientation of the intersection of the well bores 12 with the coal seam 16 relative to the linear formation of the well bores 12 at the surface 14 may be varied to accommodate a desired drainage formation or subterranean resource configuration.

Well bore patterns 60 are drilled within the target subterranean zone from the articulated well bore 40 extending from each of the enlarged cavities 30. In resource collection applications, resources from the target subterranean zone drain into each of the well bore patterns 60, where the resources are collected in the enlarged cavities 30. Once the resources have been collected in the enlarged cavities 30, the resources may be removed to the surface through the well bores 12 by the methods described above.

Figure 9:
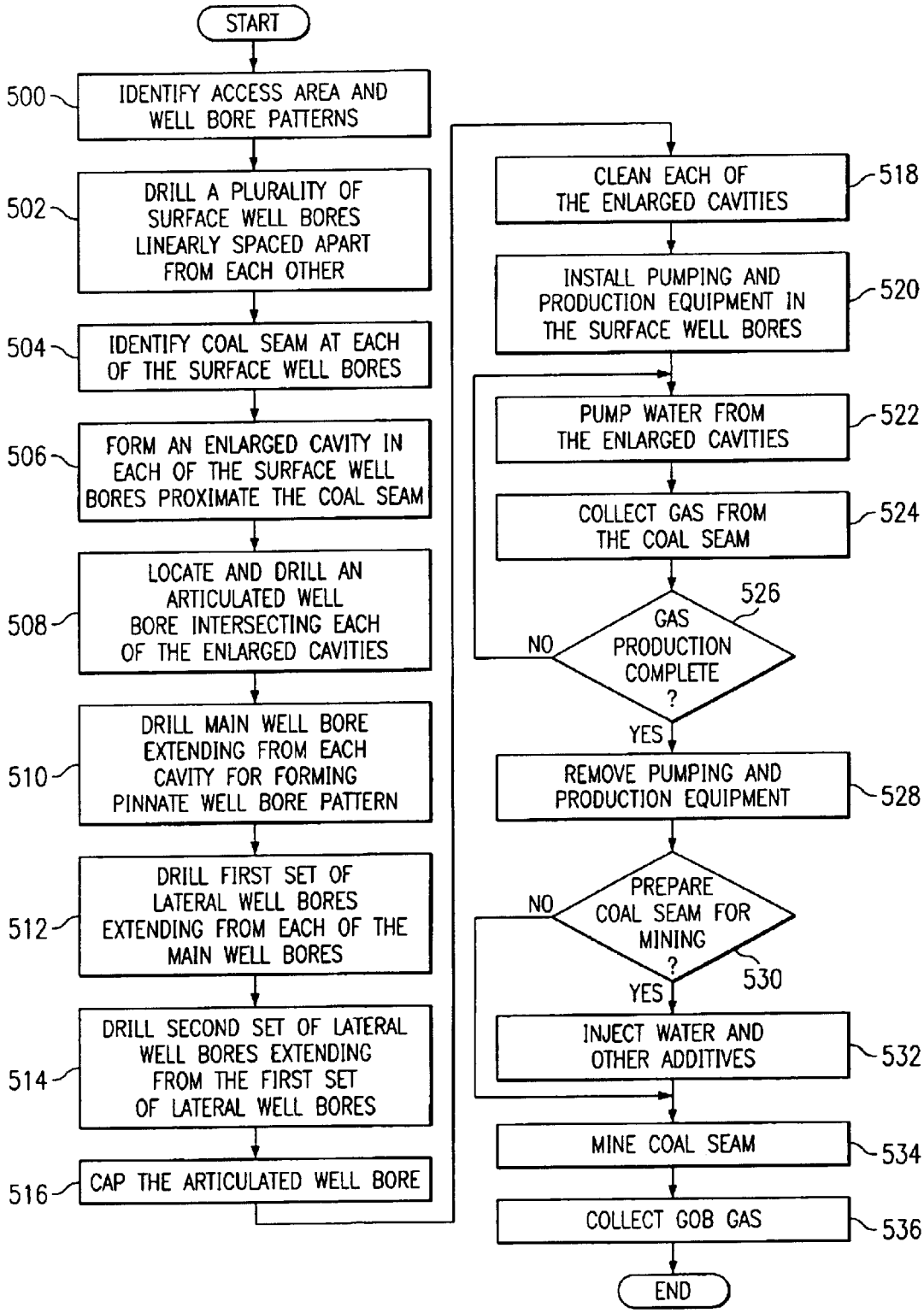
FIG. 9 is a flow diagram illustrating a method for accessing a subterranean zone from a limited surface area in accordance with an embodiment of the present invention.

FIG. 9 is a flow diagram illustrating a method for enhanced access to a subterranean resource, such as a coal seam 16, from a limited surface area in accordance with an embodiment of the present invention. In this embodiment, the method begins at step 500 in which areas to be accessed and well bore patterns for the areas are identified. Pinnate well bore patterns may be used to provide optimized coverage for the region. However, it should be understood that other suitable well bore patterns may also be used.

Proceeding to step 502, a plurality of well bores 12 are drilled from the surface 14 to a predetermined depth through the coal seam 16. The well bores 12 may be formed having a substantially linear spaced apart relationship relative to each other or may be nonlinearly disposed relative to each other while minimizing the surface area required for accessing the subterranean resource. Next, at step 504, down hole logging equipment is utilized to exactly identify the location of the coal seam 16 in each of the well bores 12. At step 506, the enlarged cavities 30 are formed in each of the well bores 12 at the location of the coal seam 16. As previously discussed, the enlarged cavities 30 may be formed by under reaming and other conventional techniques.

At step 508, the articulated well bore 40 is drilled to intersect each of the enlarged cavities 30 formed in the well bores 12. At step 510, the well bores 104 for the pinnate well bore patterns are drilled through the articulated well bore 40 into the coal seam 16 extending from each of the enlarged cavities 30. After formation of the well bores 104, lateral well bores 110 for the pinnate well bore pattern are drilled at step 512. Lateral well bores 148 for the pinnate well bore pattern are formed at step 514.

At step 516, the articulated well bore 40 is capped. Next, at step 518, the enlarged cavities 30 are cleaned in preparation for installation of downhole production equipment. The enlarged cavities 30 may be cleaned by pumping compressed air down the well bores 12 or other suitable techniques. At step 520, production equipment is installed in the well bores 12. The production equipment may include pumping units and associated equipment extending down into the cavities 30 for removing water from the coal seam 16. The removal of water will drop the pressure of the coal seam and allow methane gas to diffuse and be produced up the annulus of the well bores 12.

Proceeding to step 522, water that drains from the well bore patterns into the cavities 30 is pumped to the surface 14. Water may be continuously or intermittently pumped as needed to remove it from the cavities 30. At step 524, methane gas diffused from the coal seam 16 is continuously collected at the surface 14. Next, at decisional step 526, it is determined whether the production of gas from the coal seam 16 is complete. The production of gas may be complete after the cost of the collecting the gas exceeds the revenue generated by the well. Or, gas may continue to be produced from the well until a remaining level of gas in the coal seam 16 is below required levels for mining operations. If production of the gas is not complete, the method returns to steps 522 and 524 in which water and gas continue to be removed from the coal seam 16. Upon completion of production, the method proceeds from step 526 to step 528 where the production equipment is removed.

Next, at decisional step 530, it is determined whether the coal seam 16 is to be further prepared for mining operations. If the coal seam 16 is to be further prepared for mining operations, the method proceeds to step 532, where water and other additives may be injected back into the coal seam 16 to rehydrate the coal seam 16 in order to minimize dust, improve the efficiency of mining, and improve the mined product.

If additional preparation of the coal seam 16 for mining is not required, the method proceeds from step 530 to step 534, where the coal seam 16 is mined. The removal of the coal from the coal seam 16 causes the mined roof to cave and fracture into the opening behind the mining process. The collapsed roof creates gob gas which may be collected at step 536 through the well bores 12. Accordingly, additional drilling operations are not required to recover gob gas from a mined coal seam 16. Step 536 leads to the end of the process by which a coal seam 16 is efficiently degasified from the surface. The method provides a symbiotic relationship with the mine to remove unwanted gas prior to mining and to rehydrate the coal prior to the mining process.

Thus, the present invention provides greater access to subterranean resources from a limited surface area than prior systems and methods by providing decreasing the surface area required for dual well systems. For example, a plurality of well bores 12 may be disposed in close proximity to each other, for example, in a linearly or nonlinearly spaced apart relationship to each other, such that the well bores 12 may be located along a roadside or other generally small surface area. Additionally, the well bores 12 may include angled portions 20, 72 or 80 to accommodate formation of the articulated well bore 40 in close proximity to the well bores 12 while providing an offset to the intersection of the articulated well bore 40 with the well bores 12.

Figure 10:
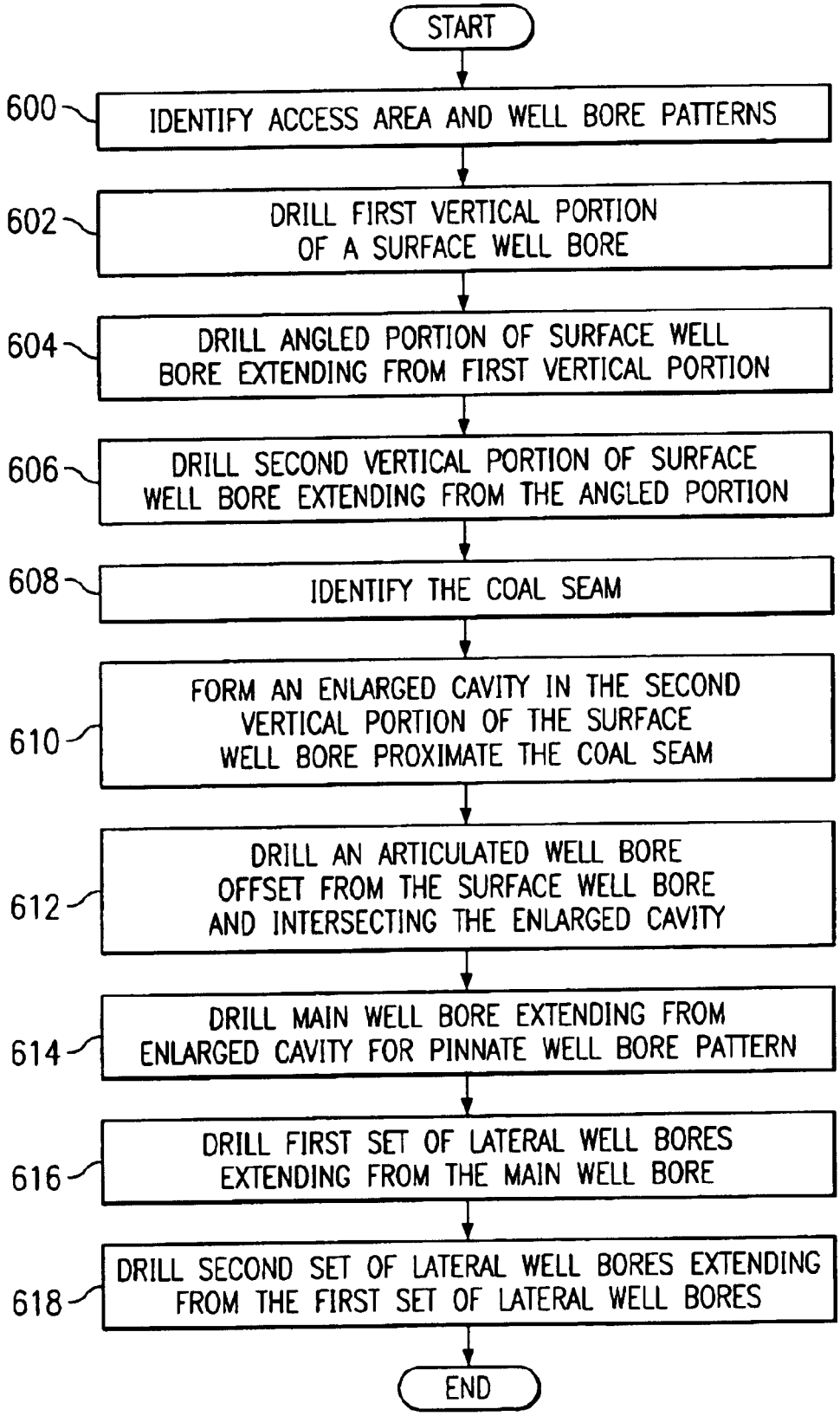
FIG. 10 is a flow diagram illustrating a method for accessing a subterranean zone from a limited surface area in accordance with another embodiment of the present invention.

FIG. 10 is a flow diagram illustrating a method for enhanced access to a subterranean resource, such as a coal seam 16, from a limited surface area in accordance with an embodiment of the present invention. In this embodiment, the method begins at step 600 in which areas to be accessed and well bore patterns for the areas are identified. Pinnate well bore patterns may be used to provide optimized coverage for the region. However, it should be understood that other suitable well bore patterns may also be used.

Proceeding to step 602, the portion 18 of the well bore 12 is formed to a predetermined depth. As described above in connection with FIG. 1, the depth of the portion 18 may vary depending on the location and desired offset distance between the intersection of the well bore 12 with the coal seam 16 and the surface location of the well bore 12. The angled portion 20 of the well bore 12 is formed at step 604 extending from the portion 18, and the portion 22 of the well bore 12 is formed at step 606 extending from the angled portion 20. As described above in connection with FIG. 1, the angular orientation of the angled portion 20 and the depth of the intersection of the angled portion 20 with the portion 22 may vary to accommodate a desired intersection location of the coal seam 16 by the well bore 12.

Next, at step 608, down hole logging equipment is utilized to exactly identify the location of the coal seam 16 in the well bore 12. At step 610, the enlarged cavity 30 is formed in the portion 22 of the well bore 12 at the location of the coal seam 16. As previously discussed, the enlarged cavity 30 may be formed by under reaming and other conventional techniques.

At step 612, the articulated well bore 40 is drilled to intersect the enlarged cavity 30 formed in the portion 22 of the well bore 12. At step 614, the well bore 104 for the pinnate well bore pattern is drilled through the articulated well bore 40 into the coal seam 16 extending from the enlarged cavity 30. After formation of the well bore 104, lateral well bores 110 for the pinnate well bore pattern are drilled at step 616. Lateral well bores 148 for the pinnate well bore pattern are formed at step 618.

Figure 11:
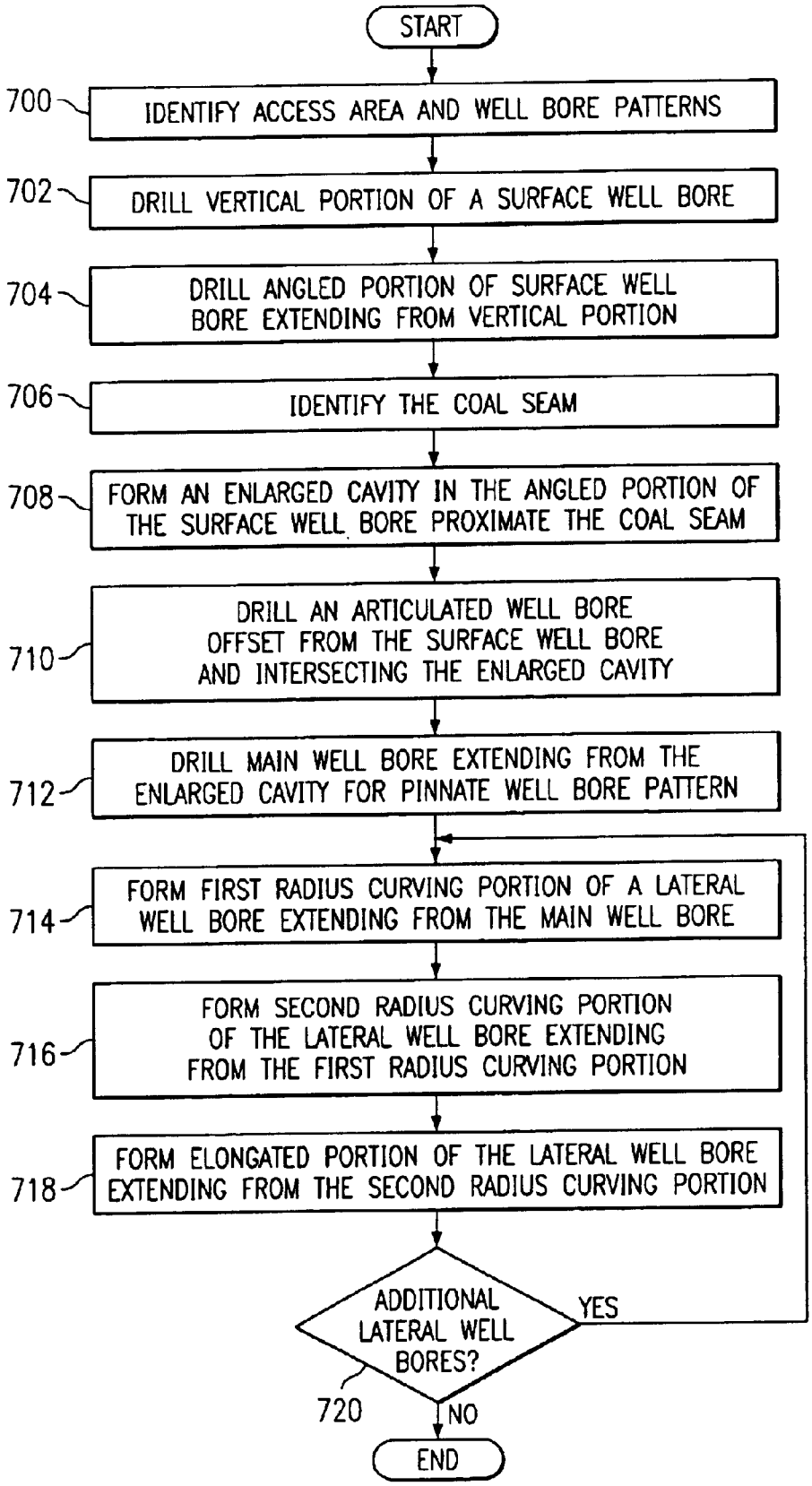
FIG. 11 is a flow diagram illustrating a method for accessing a subterranean zone from a limited surface area in accordance with another embodiment of the present invention.

FIG. 11 is a flow diagram illustrating a method for enhanced access to a subterranean resource, such as a coal seam 16, from a limited surface area in accordance with an embodiment of the present invention. In this embodiment, the method begins at step 700 in which areas to be accessed and well bore patterns for the areas are identified. Pinnate well bore patterns may be used to provide optimized coverage for the region. However, it should be understood that other suitable well bore patterns may also be used.

Proceeding to step 702, the portion 70 of the well bore 12 is formed to a predetermined depth. As described above in connection with FIG. 2, the depth of the portion 70 may vary depending on the location and desired offset distance between the intersection of the well bore 12 with the coal seam 16 and the surface location of the well bore 12. The angled portion 72 of the well bore 12 is formed at step 704 extending downwardly from the portion 70. As described above in connection with FIG. 2, the angular orientation of the angled portion 72 may vary to accommodate a desired intersection location of the coal seam 16 by the well bore 12.

Next, at step 706, down hole logging equipment is utilized to exactly identify the location of the coal seam 16 in the well bore 12. At step 708, the enlarged cavity 30 is formed in the angled portion 72 of the well bore 12 at the location of the coal seam 16. As previously discussed, the enlarged cavity 30 may be formed by under reaming and other conventional techniques.

At step 710, the articulated well bore 40 is drilled to intersect the enlarged cavity 30 formed in the angled portion 72 of the well bore 12. At step 712, the well bore 144 for the pinnate well bore pattern is drilled through the articulated well bore 40 into the coal seam 16 extending from the enlarged cavity 30. After formation of the well bore 144, a first radius curving portion 150 of a lateral well bore 110 for the pinnate well bore pattern is drilled at step 714 extending from the well bore 144. A second radius curving portion 152 of the lateral well bore 110 is formed at step 716 extending from the first radius curving portion 150. The elongated portion 154 of the lateral well bore 110 is formed at step 718 extending from the second radius curving portion 152. At decisional step 720, a determination is made whether additional lateral well bores 110 are required. If additional lateral well bores 110 are desired, the method returns to step 714. If no additional lateral well bores 110 are desired, the method ends.

Figure 12:
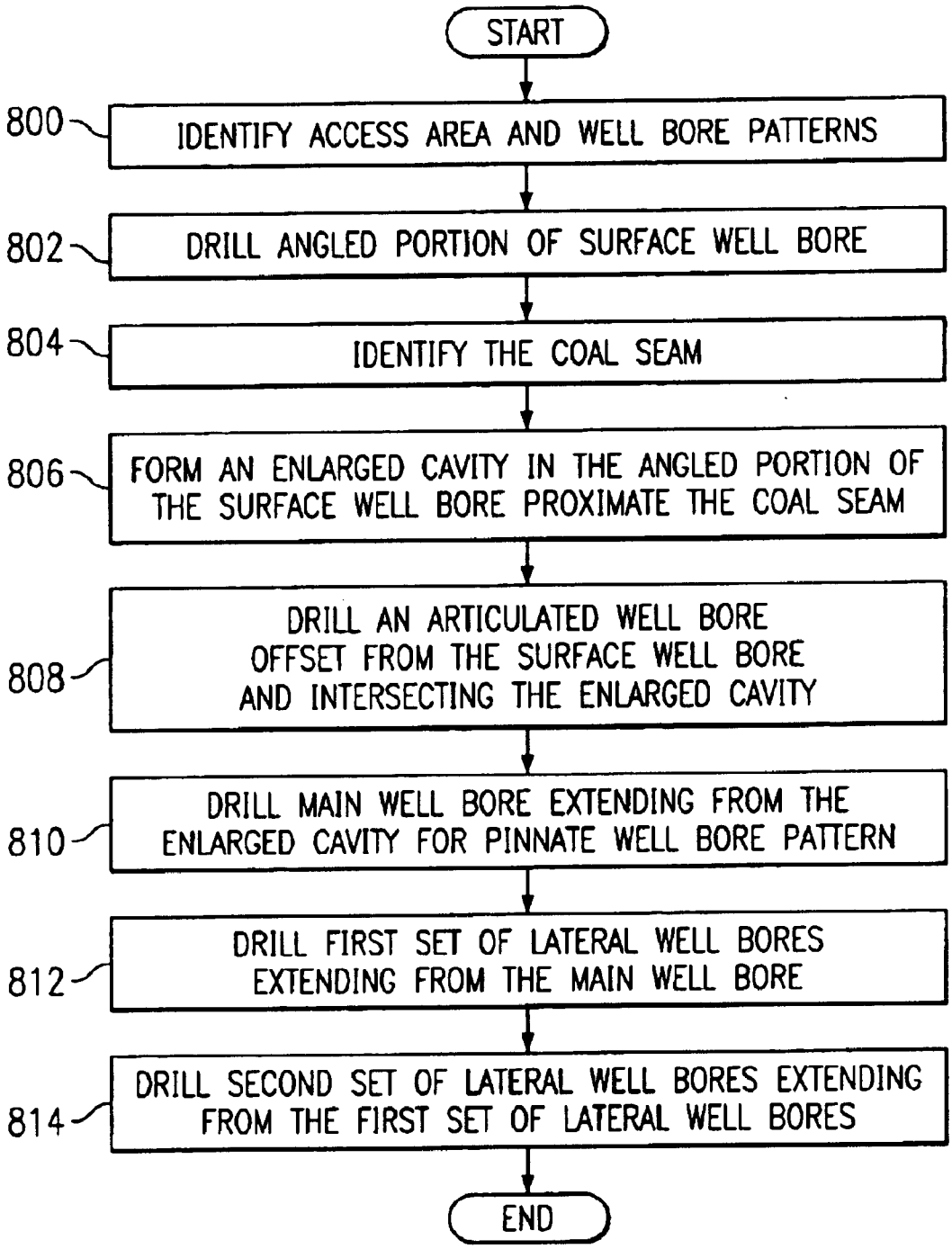
FIG. 12 is a flow diagram illustrating a method for accessing a subterranean zone from a limited surface area in accordance with another embodiment of the present invention.

FIG. 12 is a flow diagram illustrating a method for enhanced access to a subterranean resource, such as a coal seam 16, from a limited surface area in accordance with an embodiment of the present invention. In this embodiment, the method begins at step 800 in which areas to be accessed and well bore patterns for the areas are identified. Pinnate well bore patterns may be used to provide optimized coverage for the region. However, it should be understood that other suitable well bore patterns may also be used.

Proceeding to step 802, the angled portion 80 of the well bore 12 is formed. As described above in connection with FIG. 3, angular orientation of the angled portion 80 may vary to accommodate a desired intersection location of the coal seam 16 by the well bore 12. Next, at step 804, down hole logging equipment is utilized to exactly identify the location of the coal seam 16 in the well bore 12. At step 806, the enlarged cavity 30 is formed in the angled portion 80 of the well bore 12 at the location of the coal seam 16. As previously discussed, the enlarged cavity 30 may be formed by under reaming and other conventional techniques.

At step 808, the articulated well bore 40 is drilled to intersect the enlarged cavity 30 formed in the angled portion 80 of the well bore 12. At step 810, the well bore 104 for the pinnate well bore pattern is drilled through the articulated well bore 40 into the coal seam 16 extending from the enlarged cavity 30. After formation of the well bore 104, lateral well bores 110 for the pinnate well bore pattern are drilled at step 812. Lateral well bores 148 for the pinnate well bore pattern are formed at step 814.

Thus, the present invention provides greater access to subterranean resources from a limited surface area than prior systems and methods by decreasing the surface area required for dual well systems. For example, according to the present invention, the well bore 12 may be formed having an angled portion 20, 72 or 80 disposed between the surface 14 and the coal seam 16 to provide an offset between the surface location of the well bore 12 and the intersection of the well bore 12 with the coal seam 16, thereby accommodating formation of the articulated well bore 40 in close proximity to the surface location of the well bore 12.

Figure 13:
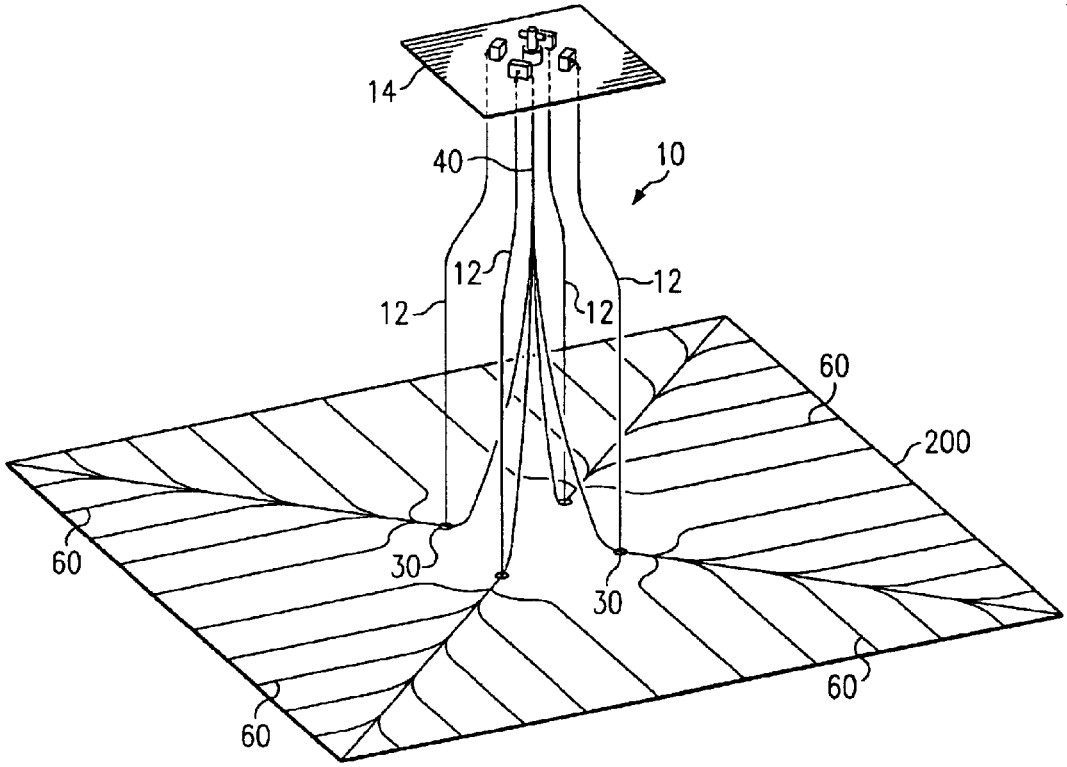
FIG. 13 is a diagram illustrating a system for accessing a subterranean zone in accordance with an embodiment of the present invention.

FIG. 13 is a diagram illustrating system 10 for accessing a subterranean zone 200 in accordance with an embodiment of the present invention. As illustrated in FIG. 13, the well bore 40 is disposed offset relative to a pattern of well bores 12 at the surface 14 and intersects each of the well bores 12 below the surface 14. In this embodiment, well bores 12 and 40 are disposed in a substantially nonlinear pattern in close proximity to each other to minimize the area required for the well bores 12 and 40 on the surface 14. In FIG. 13, well bores 12 are illustrated having a configuration as illustrated in FIG. 1; however, it should be understood that well bores 12 may be otherwise configured, for example, as illustrated in FIGS. 2–3.

Referring to FIG. 13, well bore patterns 60 are formed within the zone 200 extending from cavities 30 located at the intersecting junctions of the well bores 12 and 40 as described above. Well bore patterns 60 may comprise pinnate patterns, as illustrated in FIG. 13, or may include other suitable patterns for accessing the zone 200. As illustrated in FIG. 13, well bores 12 and 40 may be disposed in close proximity to each other at the surface 14 while providing generally uniform access to a generally large zone 200. For example, as discussed above, well bores 12 and 40 may be disposed within approximately 30 feet from each other at the surface while providing access to at least approximately 1000–1200 acres of the zone 200. Further, for example, in a nonlinear well bore 12 and 40 surface pattern, the well bores 12 and 40 may be disposed in an area generally less than five hundred square feet, thereby minimizing the footprint required on the surface 14 for system 10. Thus, the well bores 12 and 40 of system 10 may be located on the surface 14 in close proximity to each other, thereby minimizing disruption to the surface 14 while providing generally uniform access to a relatively large subterranean zone.

Although the present invention has been described with several embodiments, various changes and modifications may be suggested to one skilled in the art. It is intended that the present invention encompass such changes and modifications as fall within the scope of the appended claims.

What is claimed is:

1. A system for accessing a target zone from a limited service area, comprising:

a plurality of well bores extending from one or more surface locations to a target zone;

two or more of the well bores each including a well bore junction proximate to the target zone at which the two or more of the well bores intersect other of the plurality of well bores and the two or more of the well bores each including an extended drainage bore; and wherein a first area bounded by the one or more surface locations is smaller than a second area bounded by the junctions, and wherein the second area is smaller than a third area containing the extended drainage bores.

2. The system of claim 1, wherein the first area is less than approximately 500 square feet.

3. The system of claim 2, wherein the third area is at least approximately 1,000 acres.

4. The system of claim 1, wherein the third area is at least approximately 1,000 acres.

5. The system of claim 1, wherein the two or more well bores each including a well bore junction proximate to the target zone comprise articulated well bores.

6. The system of claim 5, wherein the well bore junctions comprise a cavity.

7. The system of claim 1, wherein the well bore junctions each comprise a cavity.

8. The system of claim 1, wherein the extended drainage bores each comprise a plurality of laterals extending from the extended drainage bore to together form a well bore pattern.

9. The system of claim 8, wherein the well bore pattern comprises a pinnate well bore pattern.

10. The system of claim 1, wherein at least one of the plurality of well bores comprises an angled portion between the surface and the target zone.

11. A system for accessing a subterranean formation from a limited surface area, comprising:

a plurality of diverging well bores extending from a surface, the diverging well bores having a footprint on the surface, the footprint having a first area;

at least one subterranean horizontal drainage pattern coupled to each of the diverging well bores, the diverging well bores extending below the subterranean horizontal drainage pattern;

the first area of the surface footprint being smaller than a second area bounded by the couplings of the subterranean horizontal drainage patterns with the diverging well bores; and the second area being smaller than a third area bounding the subterranean horizontal drainage patterns.

12. The system of claim 11, further comprising a pumping unit disposed proximate to at least one of the subterranean horizontal drainage patterns and operable to remove resources from the subterranean formation through at least one of the respective plurality of diverging well bores.

13. The system of claim 11, further comprising one or more enlarged cavities each coupled to a subterranean horizontal drainage pattern.

14. The system of claim 11, wherein one or more of the subterranean horizontal drainage patterns comprise a pinnate well bore pattern.

15. The system of claim 11, wherein one or more of the subterranean horizontal drainage patterns comprise a main drainage well bore and a plurality of lateral well bores extending from the main drainage well bore.

16. The system of claim 11, wherein the first area is less than approximately 500 square feet.

17. The system of claim 16, wherein the third area is at least approximately 1000 acres.

18. The system of claim 11, wherein the third area is at least approximately 1000 acres.

19. A method for accessing a subterranean formation from a limited surface area, comprising:

forming a plurality of diverging well bores extending from a surface footprint, the surface footprint having a first area;

forming at least one subterranean horizontal drainage pattern coupled to each of the diverging well bores, the diverging well bores extending below the subterranean horizontal drainage pattern;

the first area of the surface footprint being smaller than a second area bounded by the couplings of the subterranean horizontal drainage patterns with the diverging well bores; and the second area being smaller than a third area bounding the subterranean horizontal drainage patterns.

20. The method of claim 19, further comprising:

installing a pumping unit disposed proximate to at least one of the subterranean horizontal drainage patterns; and using the pumping unit to remove resources from the subterranean formation through at least one of the respective plurality of diverging well bores.

21. The method of claim 19, further comprising forming one or more enlarged cavities each coupled to a subterranean horizontal drainage pattern.

22. The method of claim 19, wherein one or more of the subterranean horizontal drainage patterns comprise a pinnate well bore pattern.

23. The method of claim 19, wherein one or more of the subterranean horizontal drainage patterns comprise a main drainage well bore and a plurality of lateral well bores extending from the main drainage well bore.

24. The method of claim 19, wherein the first area is less than approximately 500 square feet.

25. The method of claim 24, wherein the third area is at least approximately 1000 acres.

26. The method of claim 19, wherein the third area is at least approximately 1000 acres.

27. The system of claim 1, wherein the target zone comprises a coal seam.

28. The system of claim 11, wherein the target zone comprises a coal seam.

29. The method of claim 19, wherein the target zone comprises a coal seam.

30. A system for producing gas from a coal seam, comprising:

a surface footprint;

a plurality of well bores coupled to the surface footprint and extending to a coal seams, at least one of the plurality of well bores being slanted;

each well bore connected to a substantially horizontal well bore extending in the coal seam; and wherein environmental impact is reduced as an area of the surface footprint is smaller than an area containing the substantially horizontal well bores.

31. The system of claim 30, wherein the plurality of well bores coupled to the surface footprint and extending to the coal seam comprise diverging well bores.

32. The system of claim 31, wherein the plurality of diverging well bores extend from disparate surface locations within the surface footprint.

33. The system of claim 31, further comprising:

a plurality of lateral well bores extending from each substantially horizontal well bore to together form a well bore pattern; and wherein environmental impact is reduced as the area of the surface footprint is smaller than an area containing the well bore patterns.

* * * * *

UNITED STATES PATENT AND TRADEMARK OFFICE

CERTIFICATE OF CORRECTION

PATENT NO. : 6,986,388 B2
APPLICATION NO. : 10/406037
DATED : January 17, 2006
INVENTOR(S) : Joseph A. Zupanick and Monty H. Rial It is certified that error appears in the above-identified patent and that said Letters Patent is hereby corrected as shown below:

OTHER PUBLICATIONS, first page, column 2, line 11, delete "subterrean" and insert -- subterranean --.

OTHER PUBLICATIONS, page 4, column 2, line 4, delete "PRoduction" and insert -- Production --.

OTHER PUBLICATIONS, page 4, column 2, line 22, delete "Afron" and insert -- Arfon --.

OTHER PUBLICATIONS, page 5, column 1, lines 28-29, delete "Uncoventionally,"" and insert -- Unconventionally," --.

OTHER PUBLICATIONS, page 5, column 1, line 41, delete "Selsmic" and insert -- Seismic --.

OTHER PUBLICATIONS, page 5, column 1, line 53, delete "Successfull" and insert -- Successful --.

OTHER PUBLICATIONS, page 5, column 1, line 58, delete "Puri," and insert -- Purl, --.

OTHER PUBLICATIONS, page 5, column 2, line 24, delete "and" and insert -- Inclined and --.

OTHER PUBLICATIONS, page 5, column 2, line 73, delete "Publisher" and insert -- Published --.

OTHER PUBLICATIONS, page 6, column 2, line 22, delete "Emerson,," and insert -- Emerson, --.

OTHER PUBLICATIONS, page 6, column 2, line 46, delete "Unerground" and insert -- Underground --.

OTHER PUBLICATIONS, page 6, column 2, line 57, delete "persented" and insert -- presented --.

OTHER PUBLICATIONS, page 7, column 1, line 12, delete "P.C.,," and insert -- P.C., --.

OTHER PUBLICATIONS, page 7, column 1, line 53, delete "Diminuitive,"" and insert -- Diminutive," --.

OTHER PUBLICATIONS, page 7, column 1, line 63, delete "PCT/US2000/024518" and insert -- PCT/US2004/024518 --.

OTHER PUBLICATIONS, page 7, column 2, line 4, delete "No.v" and insert -- Nov. --.

OTHER PUBLICATIONS, page 7, column 2, line 11, delete "intol.htm," and insert -- introl.htm, --.

OTHER PUBLICATIONS, page 7, column 2, lines 15-16, delete "Gas-Pinnacle Project, Pinnacle Project,"" and insert -- Gas-Pinnacle Project," --.

OTHER PUBLICATIONS, page 7, column 2, line 17, delete "Methan" and insert -- Methane --.

OTHER PUBLICATIONS, page 7, column 2, line 21, delete "Methan" and insert -- Methane --.

OTHER PUBLICATIONS, page 7, column 2, line 26, delete "22-231 2004 (9920 pages)." and insert -- 22-23, 2004 (20 pages). --.

OTHER PUBLICATIONS, page 7, column 2, line 27, delete "Methan" and insert -- Methane --.

OTHER PUBLICATIONS, page 7, column 2, line 31, delete "Officical" and insert -- Official --.

OTHER PUBLICATIONS, page 7, column 2, line 47, delete "Diamon," and insert -- Diamond, --.

OTHER PUBLICATIONS, page 7, column 2, line 55, delete "OIl," and insert -- Oil, --.

OTHER PUBLICATIONS, page 7, column 2, line 60, delete "Fada'l," and insert -- Fada'q, --.

OTHER PUBLICATIONS, page 8, column 1, line 23, delete "Apr. 7," and insert -- Mar. 7, --.

OTHER PUBLICATIONS, page 8, column 1, lines 24-25, delete "Magazine Detail.asp?
ART ID=2507@Month Year" and insert -- Magazine_Detail.asp?
ART_ID=2507@Month_Year --.

OTHER PUBLICATIONS, page 8, column 1, line 41, delete "Impace" and insert -- Impact --.

OTHER PUBLICATIONS, page 8, column 2, line 8, delete "Formation,"" and insert -- Formations," --.

OTHER PUBLICATIONS, page 8, column 2, line 11, delete "Chabi," and insert -- Dhabi, --.

OTHER PUBLICATIONS, page 8, column 2, line 16, delete "Struck" and insert -- Stuck --.

OTHER PUBLICATIONS, page 8, column 2, line 18, delete "Chabi," and insert -- Dhabi, --.

OTHER PUBLICATIONS, page 8, column 2, line 20, delete "NAM" and insert -- NAM; --.

OTHER PUBLICATIONS, page 8, column 2, line 21, delete "NOuris," and insert -- Nouris, --.

OTHER PUBLICATIONS, page 8, column 2, line 25, delete "Synder," and insert -- Snyder, --.

OTHER PUBLICATIONS, page 8, column 2, line 31, delete "htttp://" and insert -- http:// --.

OTHER PUBLICATIONS, page 8, column 2, line 39, delete "Steams,"" and insert -- Seams," --.

SPECIFICATION, Column 2, lines 15-19, delete "The second well bore is offset from the first well bore at the surface and intersects the first well bore at a junction proximate the target zone." and insert the same on line 14, column 2 as a continuation of the paragraph.

SPECIFICATION, Column 2, line 53, delete "de-gasified" and insert -- degasified --.

SPECIFICATION, Column 19, line 13, in Claim 30, delete "seams," and insert -- seam, --.

Signed and Sealed this

Nineteenth Day of January, 2010

David J. Kappos

David J. Kappos
*Director of the United States Patent and Trademark Office*